US010515594B2

(12) United States Patent
Jang et al.

(10) Patent No.: US 10,515,594 B2
(45) Date of Patent: Dec. 24, 2019

(54) BACKLIGHT UNIT INCLUDING CONNECTOR FOR IMPROVED RELIABILITY, METHOD OF DRIVING THE SAME, AND DISPLAY DEVICE INCLUDING THE SAME

(71) Applicant: Samsung Display Co., Ltd., Yongin-Si, Gyeonggi-Do (KR)

(72) Inventors: Jin-won Jang, Asan-si (KR); Won-hyoung Kang, Asan-si (KR); Seung-wan Kim, Yongin-si (KR); Gwangteak Lee, Cheonan-si (KR); Songyi Han, Asan-si (KR); Jin-taek Hong, Hwaseong-si (KR); Seunghwan Moon, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 88 days.

(21) Appl. No.: 15/493,565

(22) Filed: Apr. 21, 2017

(65) Prior Publication Data

US 2018/0090079 A1 Mar. 29, 2018

(30) Foreign Application Priority Data

Sep. 23, 2016 (KR) ..... 10-2016-0122452

(51) Int. Cl.

| | |
|---|---|
| ***G09G 3/36*** | (2006.01) |
| ***G09G 3/34*** | (2006.01) |
| ***H05B 33/08*** | (2006.01) |

(52) U.S. Cl.

CPC ..... *G09G 3/3406* (2013.01); *G09G 3/342* (2013.01); *G09G 3/3677* (2013.01);
(Continued)

(58) Field of Classification Search

CPC .... G09G 3/3406; G09G 3/342; G09G 3/3677; G09G 3/3688; H05B 33/0806; H05B 33/0809; H05B 33/0887
(Continued)

(56) References Cited

U.S. PATENT DOCUMENTS

2003/0020701 A1* 1/2003 Nakamura ..... G06F 1/1615 345/204
2004/0113883 A1 6/2004 Kim et al.
(Continued)

FOREIGN PATENT DOCUMENTS

JP 11-016693 * 1/1999 ..... H05B 41/24
KR 1020090015609 A 2/2009
(Continued)

*Primary Examiner* — Adam J Snyder
(74) *Attorney, Agent, or Firm* — Cantor Colburn LLP

(57) ABSTRACT

A backlight unit includes a light source module including a first connection pin and a second connection pin electrically connected to the first connection pin, a power converter which provides a driving voltage to the light source module, a connector which receives a first enable signal via a first signal line and provides a second enable signal via a second signal line and a driving circuit which controls a generation of the driving voltage from the power converter in response to the second enable signal. When the connector is electrically connected to the first and second connection pins, the first enable signal is transmitted to the first connection pin via the first signal line and the connector, and the second enable signal from the second connection pin is provided to the driving circuit via the connector and the second signal line.

20 Claims, 17 Drawing Sheets

(52) U.S. Cl.
CPC ..... *G09G 3/3688* (2013.01); *H05B 33/0806* (2013.01); *H05B 33/0809* (2013.01); *G09G 2310/08* (2013.01); *G09G 2330/021* (2013.01); *G09G 2330/04* (2013.01); *H05B 33/0887* (2013.01)

(58) Field of Classification Search
USPC ..... 345/102
See application file for complete search history.

(56) References Cited

U.S. PATENT DOCUMENTS

2009/0153068 A1* 6/2009 Cho ..... H05B 41/282 315/257
2009/0201244 A1* 8/2009 Park ..... G09G 3/3406 345/102
2010/0315325 A1* 12/2010 Hwang ..... G09G 3/3406 345/102
2012/0038290 A1* 2/2012 Choi ..... G09G 3/3406 315/293
2013/0050174 A1 2/2013 Kim et al.
2013/0113844 A1* 5/2013 Kim ..... H05B 33/0887 345/690
2014/0016304 A1* 1/2014 Gao ..... H05B 33/0815 362/97.2
2014/0139132 A1* 5/2014 Kwak ..... G09G 3/006 315/224
2014/0312792 A1* 10/2014 Mi ..... H05B 33/0845 315/192
2015/0187317 A1* 7/2015 Seo ..... G09G 3/006 345/212
2016/0189581 A1* 6/2016 Hwang ..... G09G 3/006 345/691

FOREIGN PATENT DOCUMENTS

KR 1020130018065 A 2/2013
KR 1020160067964 A 6/2016

* cited by examiner

BACKLIGHT UNIT INCLUDING CONNECTOR FOR IMPROVED RELIABILITY, METHOD OF DRIVING THE SAME, AND DISPLAY DEVICE INCLUDING THE SAME

This application claims priority to Korean Patent Application No. 10-2016-0122452, filed on Sep. 23, 2016, and all the benefits accruing therefrom under 35 U.S.C. § 119, the content of which in its entirety is herein incorporated by reference.

BACKGROUND

1. Field

Exemplary embodiments of the invention relate to a backlight unit, a method of driving the same, and a display device including the backlight unit.

2. Description of the Related Art

Electronic devices equipped with a display device as a user interface have become essential, and flat panel display devices are primarily widely used as a type of the display device since the flat panel display devices are suitable for making the electronic devices lightweight, thin, short, and small and for low power consumption.

Since a liquid crystal display ("LCD"), which is one of the most widely used flat panel display devices in recent times, is a non-self-emissive type device that displays an image by controlling an amount of a light provided from the outside, the LCD uses a separate light source, i.e., a backlight unit ("BLU") including a backlight lamp, to provide the light to a liquid crystal panel of the LCD.

In recent years, a light emitting diode ("LED") has been widely used as the light source due to various advantages such as low power consumption, environment-friendly feature, and slimness. The light emitting diode is provided as a separate module and connected to a connector of a printed circuit board having a driving circuit.

SUMMARY

Exemplary embodiments of the invention provide a backlight unit having an improved reliability.

Exemplary embodiments of the invention provide a method of driving the backlight unit.

Exemplary embodiments of the invention provide a display device including the backlight unit having the improved reliability.

Exemplary embodiments of the invention provide a backlight unit including a light source module including a first connection pin and a second connection pin electrically connected to the first connection pin, a power converter which applies a driving voltage to the light source module, a connector which receives a first enable signal via a first signal line and applies a second enable signal to the driving circuit via a second signal line, and a driving circuit which controls a generation of the driving voltage from the power converter in response to the second enable signal. When the connector is electrically connected to the first connection pin and the second connection pin of the light source module, the first enable signal is transmitted to the first connection pin of the light source module via the first signal line and the connector, and the second enable signal from the second connection pin of the light source module is transmitted to the driving circuit via the connector and the second signal line.

In an exemplary embodiment, the driving circuit controls the power converter to generate the driving voltage when the second enable signal is received at a first level.

In an exemplary embodiment, the first enable signal and the second enable signal are substantially the same as each other.

In an exemplary embodiment, the driving circuit is implemented by an integrated circuit, and the light source module, the power converter, the driving circuit, and the connector are disposed on a light source driving circuit board.

In an exemplary embodiment, the backlight unit further includes an input connector which receives the first enable signal from an external device.

In an exemplary embodiment, the backlight unit further includes an overvoltage detector including at least two resistors sequentially connected between a voltage output terminal of the power converter which outputs the driving voltage and a ground voltage in series, and the driving circuit controls the power converter to stop the generation of the driving voltage when a voltage of a node between the at least two resistors is greater than a reference voltage.

In an exemplary embodiment, the backlight unit further includes a buffer circuit which receives the second enable signal from the connector via the second signal line and outputs a third enable signal obtained by removing a noise from the second enable signal, and the driving circuit controls the generation of the driving voltage from the power converter in response to the third enable signal.

In an exemplary embodiment, the buffer circuit includes a filter circuit which receives the second enable signal and outputs a switching signal to a first node, a first switching transistor including a first electrode connected to a power voltage, a gate electrode connected to the first node, and a second electrode connected to a ground voltage, and a second switching transistor including a first electrode connected to the power voltage, a gate electrode connected to the first electrode of the first switching transistor, and a second electrode connected to the ground voltage, and a signal from the first electrode of the second switching transistor is the third enable signal.

In an exemplary embodiment, the backlight unit further includes an enable delay circuit which receives the second enable signal from the connector via the second signal line and outputs a third enable signal obtained by delaying the second enable signal, and the driving circuit controls the generation of the driving voltage from the power converter in response to the third enable signal.

In an exemplary embodiment, the enable delay circuit includes a filter circuit which receives the second enable signal and outputs a switching signal, a resistor connected between the second enable signal and an output node, and a switching transistor including a first electrode connected to the output node, a gate electrode which receives the switching signal, and a second electrode connected to a ground voltage.

In an exemplary embodiment, the backlight unit further includes a buffer circuit which receives the first enable signal and outputs a third enable signal in response to the second enable signal, and the driving circuit controls the generation of the driving voltage from the power converter in response to the third enable signal.

In an exemplary embodiment, the buffer circuit includes a first filter circuit which receives the second enable signal and outputs a first switching signal, a first switching transistor including a first electrode connected to a switching node, a gate electrode connected to the first switching signal, and a second electrode connected to a ground voltage, a second switching transistor including a first electrode connected to the first enable signal, a gate electrode connected to the switching node, and a third electrode, and a second filter circuit which receives a signal of the third electrode of the second switching transistor and outputs the third enable signal.

Exemplary embodiments of the invention provide a backlight unit including a first light source module including a first connection pin and a second connection pin electrically connected to the first connection pin, a second light source module including a third connection pin and a fourth connection pin electrically connected to the third connection pin, a power converter which provides a driving voltage to the first light source module and the second light source module, a first connector electrically connected to the first and second connection pins, a second connector electrically connected to the third and fourth connection pins, a first signal line which transmits a first enable signal to the first connector, a second signal line which transmits a second enable signal from the first connector to the second connector, a third signal line which transmits a third enable signal from the second connector, and a driving circuit which controls a generation of the driving voltage from the power converter in response to the third enable signal. When the first connector is electrically connected to the first and second connection pins and the second connector is electrically connected to the third and fourth connection pins, the first enable signal is transmitted to the first connection pin of the first light source module via the first signal line and the first connector, the second enable signal from the second connection pin of the first light source module is transmitted to the third connection pin of the second light source module via the second signal line and the second connector, and the third enable signal from the fourth connection pin of the second light source module is transmitted to the driving circuit via the second connector and the third signal line.

In an exemplary embodiment, when the third enable signal is received at a first level, the driving circuit controls the power converter to generate the driving voltage.

In an exemplary embodiment, the first enable signal, the second enable signal, and the third enable signal are substantially the same as each other.

Exemplary embodiments of the invention provide a display device including a display panel including a plurality of pixels, a panel driving circuit which controls the display panel to display an image, and a backlight unit which provides a light to the display panel. The backlight unit includes a light source module including a first connection pin and a second connection pin electrically connected to the first connection pin, a power converter which provides a driving voltage to the light source module, a connector which receives a first enable signal via a first signal line and provides a second enable signal via a second signal line, and a driving circuit which controls a generation of the driving voltage from the power converter in response to the second enable signal. When the connector is electrically connected to the first connection pin and the second connection pin of the light source module, the first enable signal is transmitted to the first connection pin of the light source module via the first signal line and the connector, and the second enable signal from the second connection pin of the light source module is transmitted to the driving circuit via the connector and the second signal line.

In an exemplary embodiment, the driving circuit controls the power converter to generate the driving voltage when the second enable signal is received at a first level.

In an exemplary embodiment, the panel driving circuit includes a gate driver which drives a plurality of gate lines connected to the plurality of pixels in a first direction, a data driver which drives a plurality of data lines connected to the plurality of pixels in a second direction different from the first direction, and a timing controller which controls the gate driver and the data driver and outputs a backlight control signal, and the driving circuit controls the generation of the driving voltage from the power converter in response to the backlight control signal.

Exemplary embodiments of the invention provide a method of operating a backlight unit, including receiving a first enable signal via a first signal line, transmitting the first enable signal to a first connection pin of a light source module, receiving a second enable signal from a second connection pin of the light source module via a second signal line, generating a driving voltage when the second enable signal is at a first level, and providing the driving voltage to the light source module.

In an exemplary embodiment, the method further includes comparing the driving voltage with a reference voltage and stopping the generation of the driving voltage when the driving voltage is greater than the reference voltage.

According to the above, the backlight unit may stop the generation of the driving voltage when the light source module is not connected to the connector. Thus, the backlight unit may be prevented from being damaged and from malfunctioning even though the light source module is not connected to the connector, and as a result, reliability of the backlight unit may be improved.

BRIEF DESCRIPTION OF THE DRAWINGS

The above and other advantages of the invention will become readily apparent by reference to the following detailed description when considered in conjunction with the accompanying drawings, in which.

DETAILED DESCRIPTION

Figure 1:
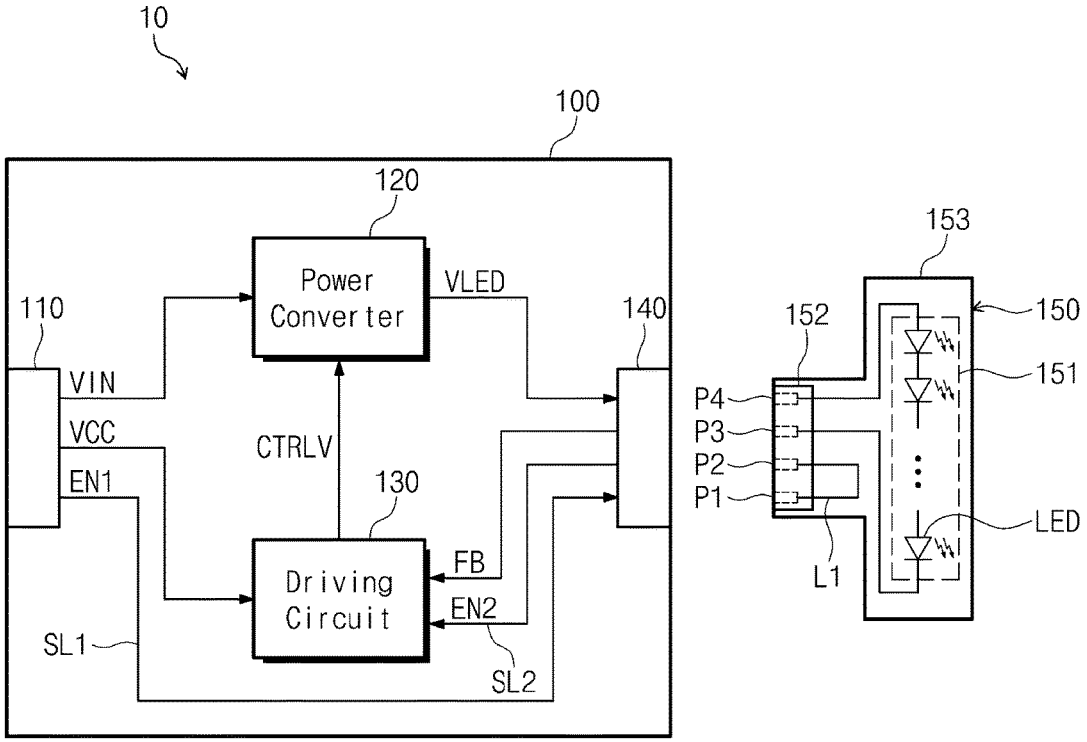
FIG. 1 is a view showing an exemplary embodiment of a backlight unit according to the invention.

Hereinafter, the invention will be explained in detail with reference to the accompanying drawings. This invention may, however, be embodied in many different forms, and should not be construed as limited to the exemplary embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular exemplary embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized exemplary embodiments. As such, variations from the shapes of the illustrations as a result, for example, of manufacturing techniques and/or tolerances, are to be expected. Thus, exemplary embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a view showing a backlight unit 10 according to an exemplary embodiment of the invention.

Referring to FIG. 1, the backlight unit 10 includes a light source driving circuit board 100 and a light source module 150. The light source driving circuit board 100 includes an input connector 110, a power converter 120, a driving circuit 130, and a connector 140, which are disposed (e.g., mounted) thereon. However, the invention is not limited thereto, and the light source driving circuit board 100 may further include other components desired for an operation of the backlight unit 10 in addition to the above-described components.

The input connector 110 receives an input voltage VIN, a power voltage VCC, and a first enable signal EN1 from an external device (not shown). The power converter 120 receives the input voltage VIN from the input connector 110 and a power control signal CTRLV from the driving circuit 130 and generates a driving voltage VLED. The driving circuit 130 receives the power voltage VCC from the input connector 110 and a feedback signal FB and a second enable signal EN2 from the connector 140 and outputs the power control signal CTRLV. The driving circuit 130 may uniformly control an amount of electric current that flows through a light emitting diode array 151 in response to the feedback signal FB.

The first enable signal EN1 from the input connector 110 is provided to the connector 140 via a first signal line SL1. The second enable signal EN2 from the connector 140 is provided to the driving circuit 130 via a second signal line SL2. The connector 140 is connected to a connector 152 of the light source module 150 and electrically connects the light source module 150 to the power converter 120 and the driving circuit 130.

The light source module 150 includes a printed circuit board ("PCB") 153, the light emitting diode array 151, and the connector 152. The light emitting diode array 151 and the connector 152 are disposed (e.g., mounted) on the PCB 153. First, second, third, and fourth connection pins P1, P2, P3, and P4 are disposed inside the connector 152.

The light source module 150 shown in FIG. 1 includes four connection pins P1 to P4, but, the number of connection pins should not be limited to four. The light emitting diode array 151 includes a plurality of light emitting diodes LED sequentially connected in series between the fourth connection pin P4 and the third connection pin P3. The first connection pin P1 and the second connection pin P2 may be electrically connected to each other through a signal line L1.

Figure 2:
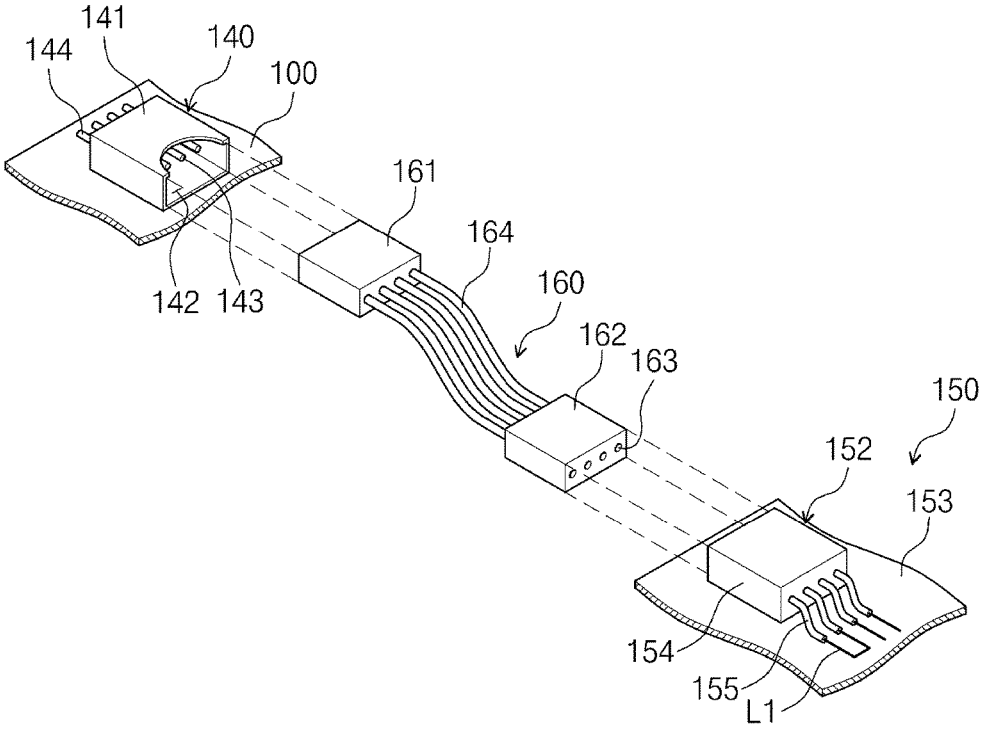
FIG. 2 is a perspective view showing a connection between a light source driving circuit board and a light source module shown in FIG. 1.

FIG. 2 is a perspective view showing a connection between the light source driving circuit board and the light source module shown in FIG. 1.

Referring to FIG. 2, the light source driving circuit board 100 and the light source module 150 may be connector-coupled with each other by a connection member 160. Therefore, a driving signal generated by the light source driving circuit board 100 is provided to the light source module 150 through the connection member 160 to drive the light source module 150.

In detail, the connector 140 of the light source driving circuit board 100 includes a housing 141 including an insulating material, a slot 142 defined in one side of the housing 141, and a plurality of leads 144 disposed at the other side of the housing 141. In addition, a plurality of connection pins 143 is arranged inside the housing 141.

Similar to the connector 140 of the light source driving circuit board 100, the connector 152 of the light source module 150 includes a housing 154 including an insulating material, a slot (not shown) defined in one side of the housing 154, and a plurality of leads 155 disposed at the other side of the housing 154. In addition, the first to fourth connection pins P1 to P4 shown in FIG. 1 may be arranged inside the housing 154.

The connection member 160 includes a flexible cable 164 and cable holders 161 and 162. That is, the connection member 160 may include the flexible cable 164 including a plurality of conductive lines separated and insulated from each other and the cable holders 161 and 162 disposed at opposite ends of the flexible cable 164 and including the insulating material.

The connector 140 of the light source driving circuit board 100 and the connector 152 of the light source module 150 contact each other by the connection member 160, i.e., the flexible cable 164 and the cable holders 161 and 162. In other words, one cable holder 162 connected to one end of the flexible cable 164 is inserted into the slot (not shown) of the connector 152 of the light source module 150, and the other cable holder 161 connected to the other end of the flexible cable 164 is inserted into the slot 142 of the connector 140 of the light source driving circuit board 100.

A plurality of pin-holes (not shown), which is connected to the connection pins 143 disposed inside the connector 140, is arranged in the cable holder 161, and a plurality of pin-holes 163, which is connected to the first to fourth connection pins P1 to P4 (shown in FIG. 1) disposed inside the connector 152, is arranged in the cable holder 162.

In FIG. 2, the light source driving circuit board 100 is connector-coupled to the light source module 150 through the connection member 160, but, the coupling method of the light source driving circuit board 100 and the light source module 150 should not be limited thereto or thereby. In another exemplary embodiment, the light source driving circuit board 100 and the light source module 150 may be socket-coupled to each other.

Figure 3:
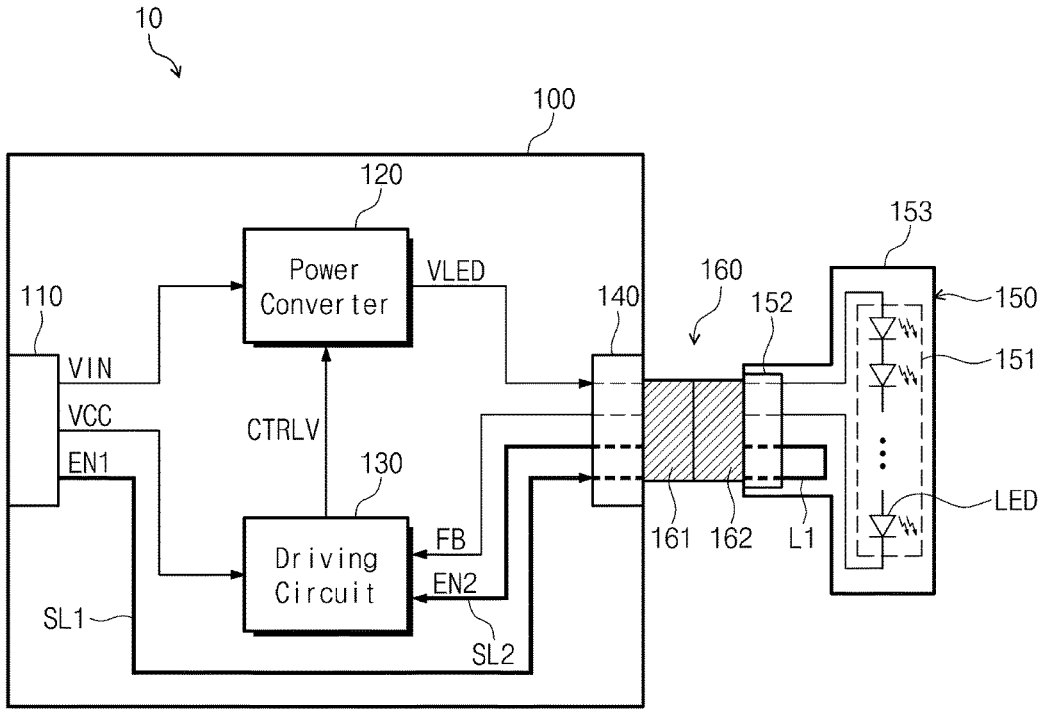
FIG. 3 is a view showing a connection between a connector and a light source module shown in FIG. 1.

FIG. 3 is a view showing a connection between the connector and the light source module 150 shown in FIG. 1.

Referring to FIGS. 1 and 3, when the connector 152 of the light source module 150 is connected to the connector 140 of the light source driving circuit board 100 via the connection member 160, the first signal line SL1 is electrically connected to the first connection pin P1 of the light source module 150, and the second connection pin P2 of the light source module 150 is electrically connected to the second signal line SL2.

The first enable signal EN1 provided from the external device is transmitted to the first connection pin P1 of the light source module 150 through the first signal line SL1 and the connector 140. Since the first connection pin P1 and the second connection pin P2 of the light source module 150 are electrically connected to each other via the signal line L1, the first enable signal EN1 from the first connection pin P1 is transmitted to the second connection pin P2. The second enable signal EN2 from the second connection pin P2 of the light source module 150 is provided to the driving circuit 130 via the second signal line SL2. The first enable signal EN1 and the second enable signal EN2 differ in name for convenience, but the first enable signal EN1 and the second enable signal EN2 are substantially the same signal. When the second enable signal EN2 is at a first level (e.g., a high level), the driving circuit 130 outputs the power control signal CTRLV at the first level (e.g., the high level) such that the power converter 120 is controlled to generate the driving voltage VLED. The power converter 120 generates the driving voltage VLED in response to the power control signal CTRLV at the first level.

In a case that the connector 152 of the light source module 150 is not connected to the connector 140 of the light source driving circuit board 100, the first enable signal EN1 provided from the external device is not transmitted to the light source module 150, and thus the driving circuit 130 may not receive the second enable signal EN2 at the first level. The driving circuit 130 is maintained in a non-operating state when the second enable signal EN2 at the first level is not applied to the driving circuit 130. The power converter 120 does not generate the driving voltage VLED when the power control signal CTRLV at the first level is not provided from the driving circuit 130.

Figure 4:
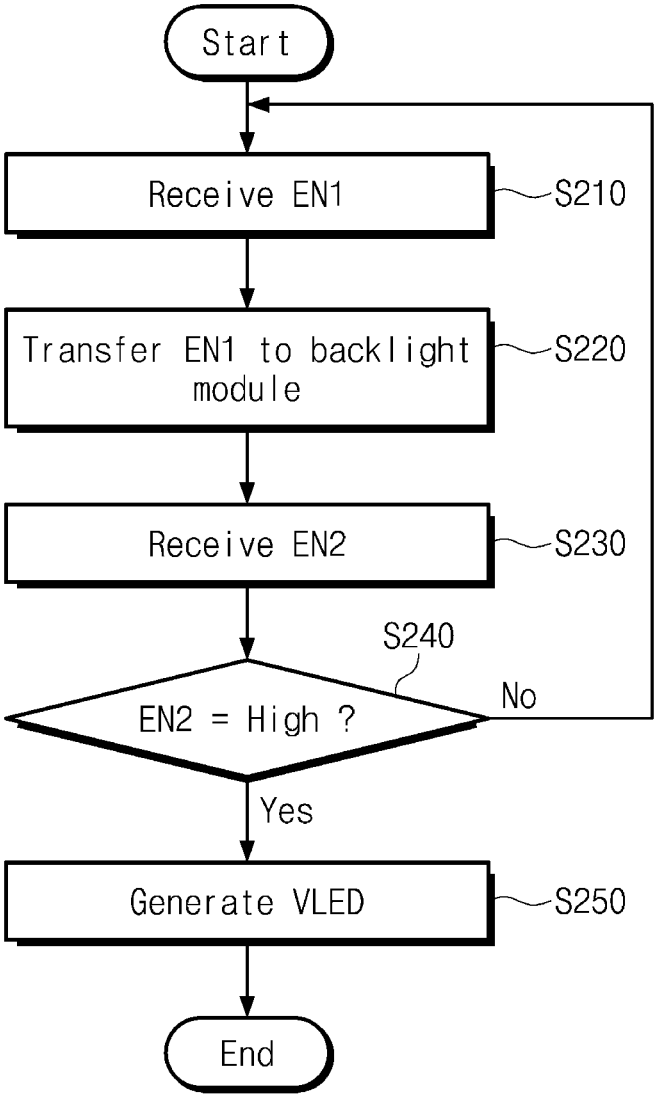
FIG. 4 is a flowchart showing an operation of the backlight unit shown in FIG. 3.

FIG. 4 is a flowchart showing an operation of the backlight unit shown in FIG. 3.

Referring to FIGS. 3 and 4, the input connector 110 of the backlight unit 10 receives the first enable signal EN1 from the external device (S210). The first enable signal EN1 is applied to the first connection pin P1 of the light source module 150 through the first signal line SL1 and the connector 140 (S220). The first enable signal EN1 applied to the first connection pin P1 of the light source module 150 is transmitted to the second connection pin P2 of the light source module 150 through the signal line L1. The driving circuit 130 receives the second enable signal EN2 from the second connection pin P2 of the light source module 150 through the connector 140 and the second signal line SL2 (S230).

The driving circuit 130 checks whether the second enable signal EN2 is at the first level (e.g., the high level) (S240). In a case that the second enable signal EN2 is at the first level, the driving circuit 130 outputs the power control signal CTRLV such that the power converter 120 generates the driving voltage VLED. The power converter 120 generates the driving voltage VLED in response to the power control signal CTRLV (S250). When the connector 140 of the light source driving circuit board 100 does not contact the connector 152 of the light source module 150, it is checked that the second enable signal EN2 is not at the first level. In the case that the second enable signal EN2 is not at the first level, the driving circuit 130 outputs the power control signal CTRLV such that the converter 120 does not generate the driving voltage VLED.

Figure 5:
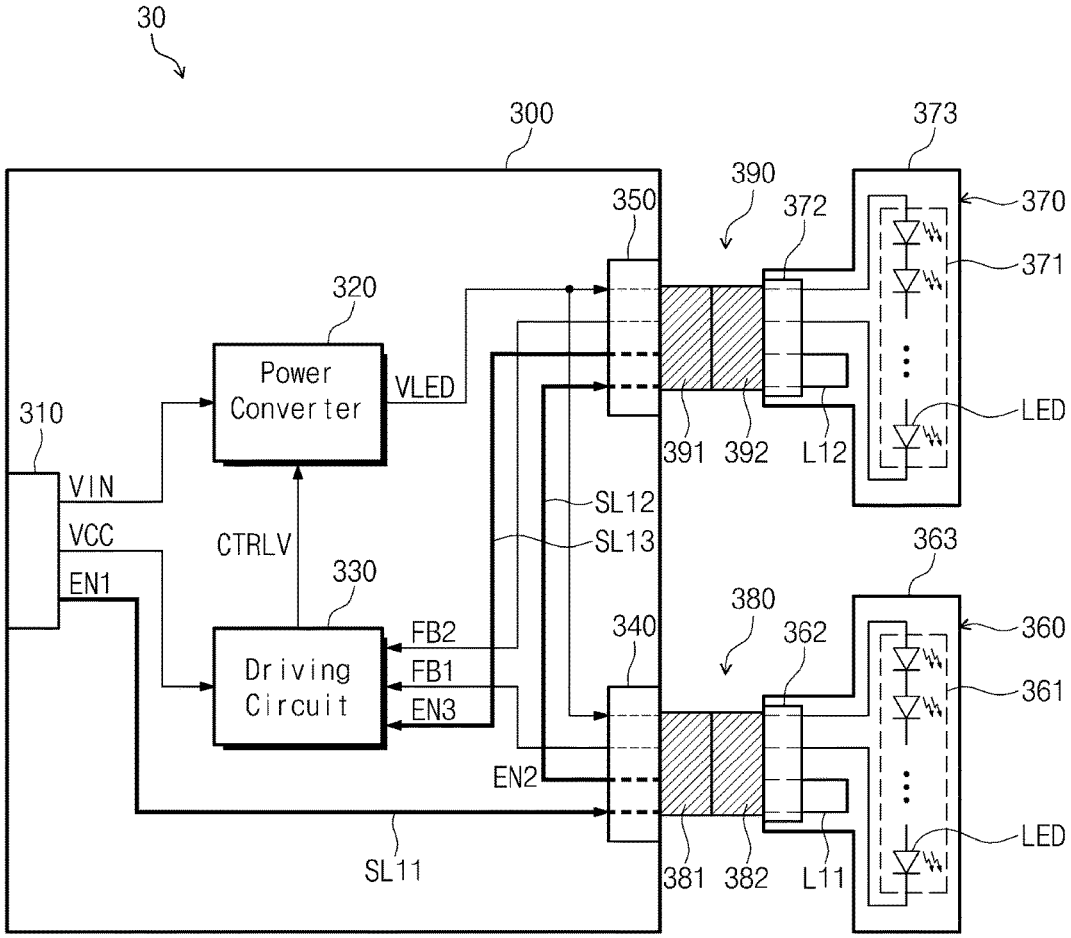
FIG. 5 is a view showing an exemplary embodiment of a backlight unit according to the invention.

FIG. 5 is a view showing a backlight unit 30 according to an exemplary embodiment of the invention.

Referring to FIG. 5, the backlight unit 30 includes a light source driving circuit board 300, a first light source module 360, and a second light source module 370. The light source driving circuit board 300 includes an input connector 310, a power converter 320, a driving circuit 330, a first connector 340, and a second connector 350, which are disposed (e.g., mounted) thereon. The light source driving circuit board 300 may further include other components desired for an operation of the backlight unit 30 in addition to the above-described components.

The input connector 310 receives an input voltage VIN, a power voltage VCC, and a first enable signal EN1 from an external device (not shown). The power converter 320 receives the input voltage VIN from the input connector 310 and a power control signal CTRLV from the driving circuit 330 and generates a driving voltage VLED. The driving circuit 330 receives the power voltage VCC from the input connector 310, a first feedback signal FB1 from the first connector 340, and a second feedback signal FB2 and a third enable signal EN3 from the second connector 350 and outputs the power control signal CTRLV. The driving circuit 330 may uniformly control an amount of electric current flowing through a light emitting diode array 361 in response to the first feedback signal FB1. The driving circuit 330 may uniformly control an amount of electric current flowing through a light emitting diode array 371 in response to the second feedback signal FB2.

The first connector 340 is connected to a connector 362 of the first light source module 360 to electrically connect the first light source module 360 to the power converter 320 and the driving circuit 330. The second connector 350 is connected to a connector 372 of the second light source module 370 to electrically connect the second light source module 370 to the power converter 320 and the driving circuit 330.

The first light source module 360 includes a PCB 363, the light emitting diode array 361, and the connector 362. The light emitting diode array 361 and the connector 362 are disposed (e.g., mounted) on the PCB 363. The connector 362 contacts the first connector 340 via a first connection member 380. The connector 362 includes connection pins (not shown). The connection pins are electrically connected to a first signal line SL11, a second signal line SL12, the power converter 320, and the driving circuit 330 through the first connector 340. The first connection member 380 includes cable holders 381 and 382. Since the structure of the first connection member 380 is similar to that of the connection member 160 shown in FIG. 2, detailed descriptions thereof will be omitted.

The second light source module 370 includes a PCB 373, the light emitting diode array 371, and the connector 372. The light emitting diode array 371 and the connector 372 are disposed (e.g., mounted) on the PCB 373. The connector 372 contacts the second connector 350 via a second connection member 390. The connector 372 includes connection pins (not shown). The connection pins are electrically connected to the second signal line SL12, a third signal line SL13, the power converter 320, and the driving circuit 330 through the second connector 350. The second connection member 390 includes cable holders 391 and 392. Since the structure of the second connection member 390 is similar to that of the connection member 160 shown in FIG. 2, detailed descriptions thereof will be omitted.

The first enable signal EN1 from the input connector 310 is provided to the first light source module 360 via the first signal line SL11 and the first connector 340. A second enable signal EN2 output from the first connector 340 through a signal line L11 arranged in the PCB 363 of the first light source module 360 is provided to the second light source module 370 via the second signal line SL12 and the second connector 350. The third enable signal EN3 output from the second connector 350 through a signal line L12 arranged in the PCB 373 of the second light source module 370 is provided to the driving circuit 330 via the third signal line SL13.

When the third enable signal EN3 at a first level is applied to the driving circuit 330, the driving circuit 330 outputs the power control signal CTRLV to allow the power converter 320 to generate the driving voltage VLED.

In a case that at least one of either the connector 362 of the first light source module 360 or the connector 372 of the second light source module 370 does not contact the first connector 340 and the second connector 350, the driving circuit 330 may not receive the third enable signal EN3 at the first level even though the input connector 310 receives the first enable signal EN1 at the first level from the external device.

Figure 6:
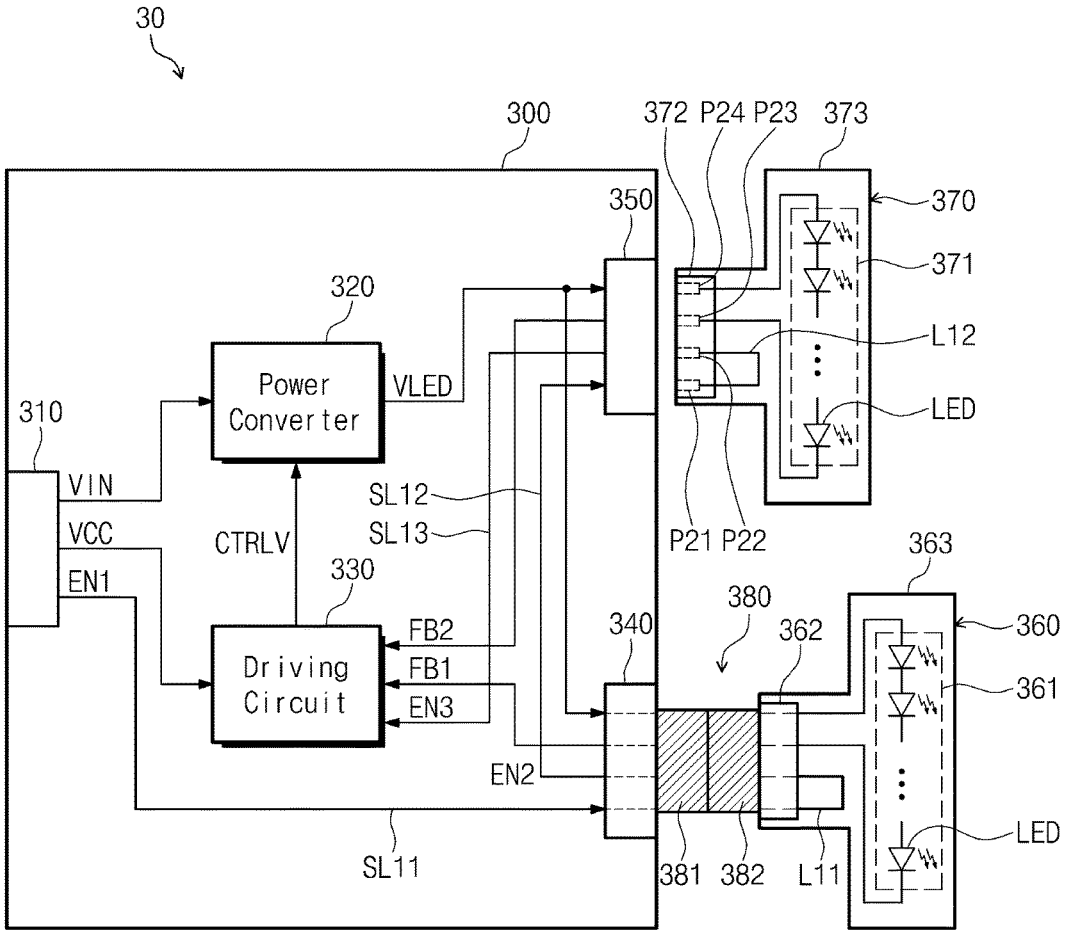
FIG. 6 is a view showing a state in which a second light source driving circuit board of FIG. 5 is not connected to a second light source module.

FIG. 6 is a view showing a state in which the second connector 350 of FIG. 5 is not connected to the second light source module 370.

Referring to FIG. 6, in a case that the connector 372 of the second light source module 370 is not inserted into the second connector 350, connection pins P21 to P24 arranged in the connector 372 of the second light source module 370 may not be electrically connected to the second signal line SL12, the driving circuit 330, and the power converter 320. Although the light source driving circuit board 300 receives the first enable signal EN1 at the first level from the external device, the driving circuit 330 does not receive the third enable signal EN3 at the first level.

When the driving circuit 330 does not receive the third enable signal EN3 at the first level, the driving circuit 330 is maintained in an inactive state. When the power converter 320 does not receive the power control signal CTRLV at the first level from the driving circuit 330, the power converter 320 does not generate the driving voltage VLED.

The driving voltage VLED generated from the power converter 320 is set to have a voltage level obtained by considering both the light emitting diode array 361 of the first light source module 360 and the light emitting diode array 371 of the second light source module 370. In a case that the power converter 320 generates the driving voltage VLED when the first connector 340 is connected to the connector 362 of the first light source module 360 and the second connector 350 is not connected to the connector 372 of the second light source module 370, an overcurrent may flow through the light emitting diode array 361 of the first light source module 360 connected to the first connector 340, and thus light emitting diodes LED arranged in the light emitting diode array 361 may be damaged.

Figure 7:
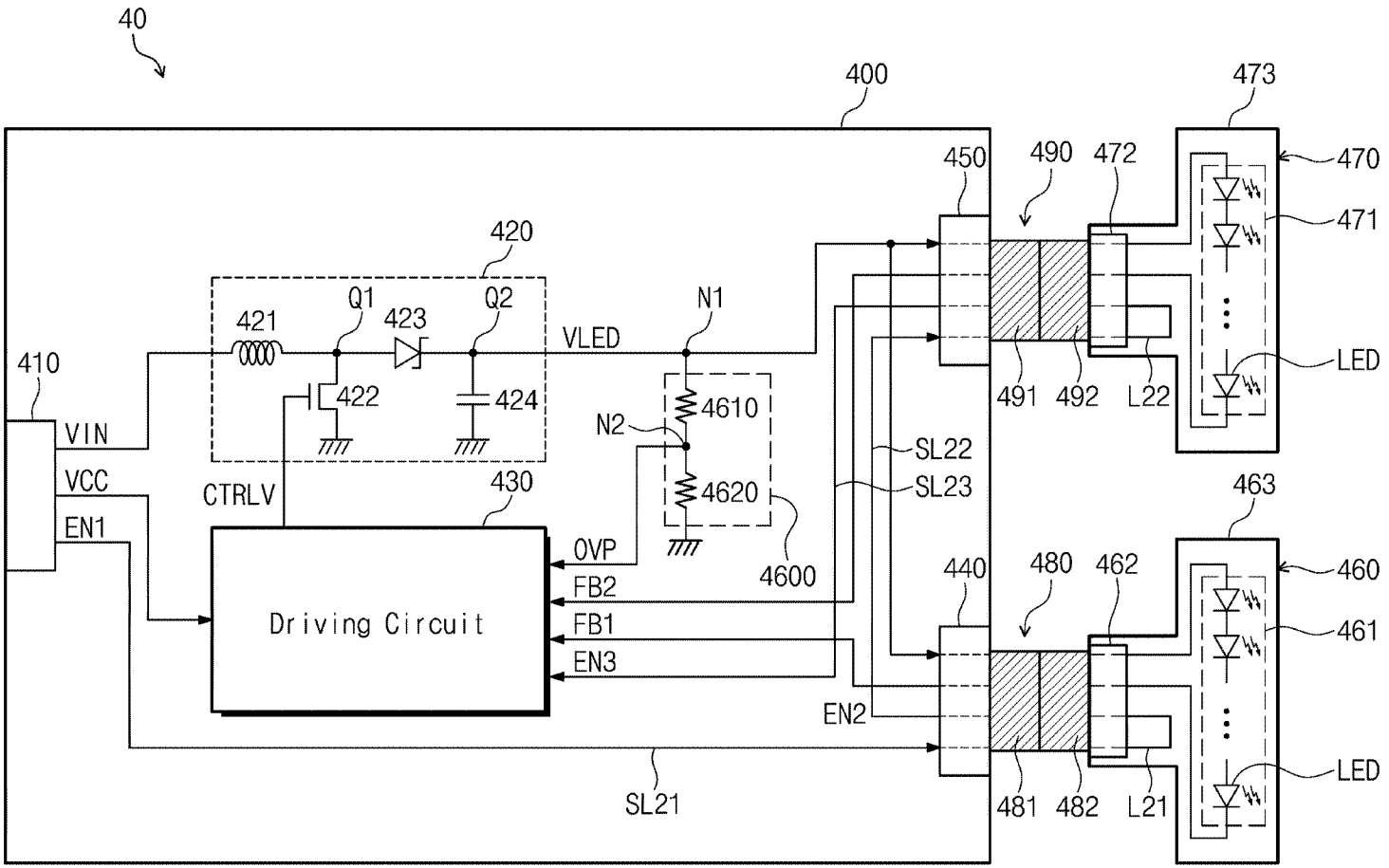
FIG. 7 is a view showing a backlight unit including an overvoltage detection circuit.

FIG. 7 is a view showing a backlight unit 40 including an overvoltage detection circuit.

Referring to FIG. 7, the backlight unit 40 includes a light source driving circuit board 400, a first light source module 460, and a second light source module 470. The light source driving circuit board 400 includes an input connector 410, a power converter 420, a driving circuit 430, a first connector 440, a second connector 450, first to third signal lines SL21 to SL23 and an overvoltage detection circuit 4600, which are disposed (e.g., mounted) thereon. The light source driving circuit board 400 may further include other components desired for an operation of the backlight unit 40 in addition to the above-described components. A connector 462 of the first light source module 460 is connected to the first connector 440 via a first connection member 480 including the cable holders 481 and 482, and a connector 472 of the second light source module 470 is connected to the second connector 450 via a second connection member 490 including the cable holders 491 and 492. Since the input connector 410, the power converter 420, the first connector 440, the second connector 450, the first light source module 460, and the second light source module 470 have the same structure and function as those of the input connector 310, the power converter 320, the first connector 340, the second connector 350, the first light source module 360, and the second light source module 370 shown in FIG. 5, detailed descriptions thereof will be omitted.

The power converter 420 converts an input voltage VIN provided from an external device to a driving voltage VLED. A voltage level of the driving voltage VLED is set to a voltage level that is enough to drive a light emitting diode array 461 of the first light source module 460 on the PCB 463 and a light emitting diode array 471 of the second light source module 470 on the PCB 473. The first and second light source modules 460 and 470 may further include the signal lines L21 and L22, respectively.

The power converter 420 includes an inductor 421, a transistor 422, a diode 423, and a capacitor 424. The inductor 421 is connected between the input voltage VIN provided from the external device and a node Q1. The transistor 422 includes a first electrode connected to the node Q1, a second electrode connected to a ground terminal, and a gate electrode connected to a power control signal CTRLV provided from the driving circuit 430. The diode 423 is connected between the node Q1 and a node Q2. In the exemplary embodiment, the diode 423 may be, but not limited to, a schottky diode. The capacitor 424 is connected to the node Q2 and the ground terminal. The driving voltage VLED is applied to one end of the light emitting diode array 461 of the first light source module 460 and one end of the light emitting diode array 471 of the second light source module 460 through the first connector 440 and the second connector 450. The power converter 420 converts the input voltage provided from the external device to the driving voltage VLED and outputs the driving voltage VLED. Especially, the voltage level of the driving voltage VLED may be adjusted by the transistor 422 turned on/off in response to the power control signal CTRLV applied to the gate electrode of the transistor 422.

The power converter 420 may include one of various types of DC/DC converters, such as a buck-boost type DC/DC converter, a boost type DC/DC converter, and a high-bridge type DC/DC converter, etc.

The overvoltage detection circuit 4600 includes resistors 4610 and 4620. The resistors 4610 and 4620 are sequentially connected between a first node N1 from which the driving voltage VLED is output and the ground terminal in series. A voltage of a second node N2, which serves as a connection node between the resistors 4610 and 4620, is applied to the driving circuit 430 as an overvoltage detection voltage OVP. The driving circuit 430 compares the overvoltage detection voltage OVP with an internal reference voltage. In a case that the overvoltage detection voltage OVP has a voltage level greater than that of the internal reference voltage, the driving circuit 430 outputs the power control signal CTRLV at a second level such that the power converter 420 stops a generation of the driving voltage VLED.

In a case that the second light source module 470 is not connected to the second connector 450, the voltage level of the driving voltage VLED increases as no current flows through the light emitting diode array 471, for example. Due to the increase of the voltage level of the driving voltage VLED, the overcurrent may flow through the light emitting diode array 461 of the first light source module 460. The driving circuit 430 outputs the power control signal CTRLV at the second level to stop the generation of the driving voltage VLED when the overvoltage detection voltage OVP becomes greater than the internal reference voltage. In this case, the internal reference voltage is desired to have a voltage level that is enough to drive both of the light emitting diode array 461 and the light emitting diode array 471. In a case that the internal reference voltage is set to a high voltage level, the overcurrent flows through the light emitting diode array 461 of the first light source module 460, and then the generation of the driving voltage VLED is stopped.

In the backlight unit 40 according to the invention, when the connector 472 of the second light source module 470 is not connected to the second connector 450 or the connector 472 of the second light source module 470 is detached from the second connector 450 during a normal operation, a third enable signal EN3 at the first level is not applied to the driving circuit 430. In this case, the power converter 420 stops the generation of the driving voltage VLED, and thus the other circuit components included in the first light source module 460 and the light source driving circuit board 400 may be prevented from being damaged by the high voltage or the overcurrent. Similarly, in the backlight unit 40 according to the invention, when the connector 462 of the first light source module 460 is not connected to the first connector 440 or the connector 462 of the first light source module 460 is detached from the first connector 440 during the normal operation, the generation of the driving voltage VLED is stopped. Thus, the other circuit components included in the second light source module 460 and the light source driving circuit board 400 may be prevented from being damaged by the high voltage or overcurrent.

Figure 8:
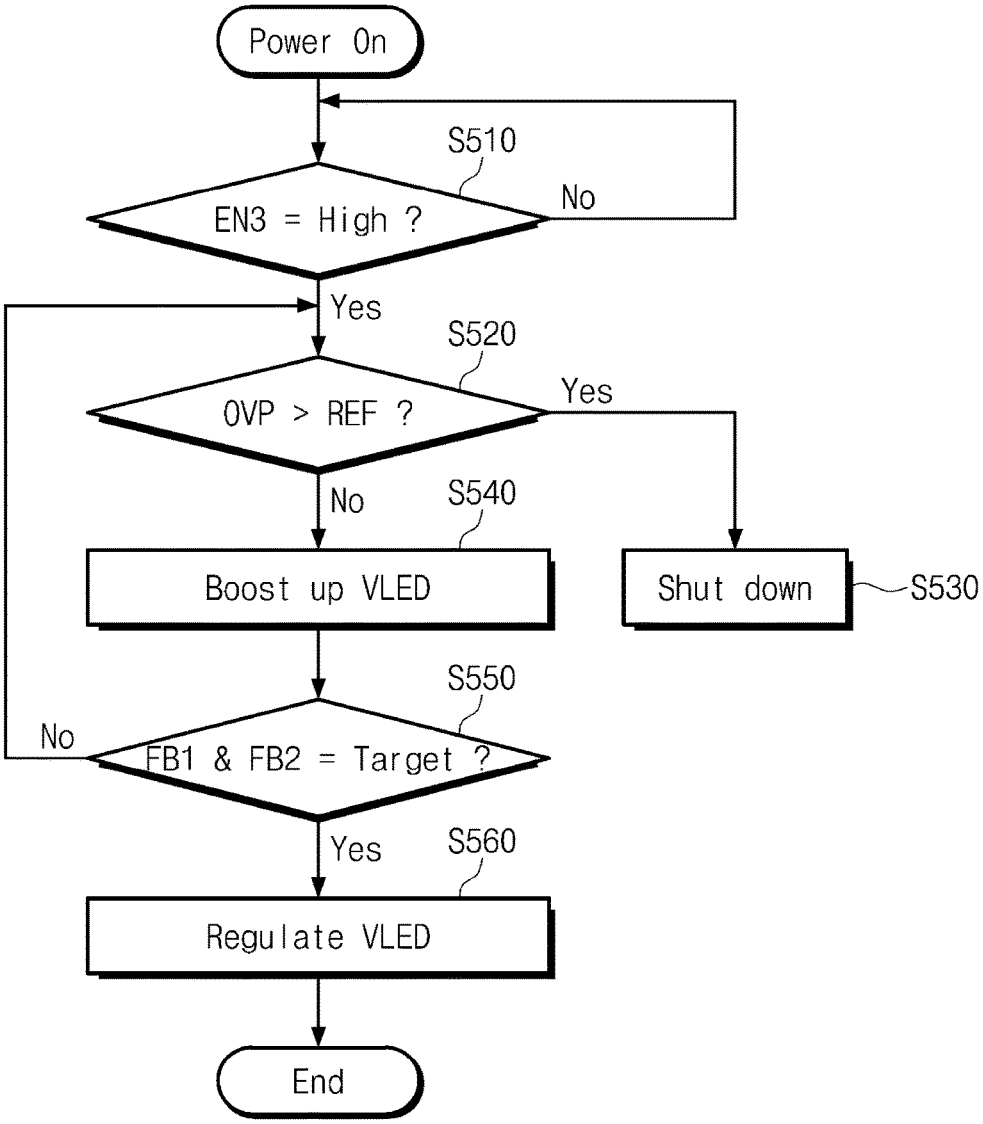
FIG. 8 is a flowchart showing an operation of a driving circuit in the backlight unit shown in FIG. 7.

FIG. 8 is a flowchart showing an operation of the driving circuit in the backlight unit shown in FIG. 7.

Referring to FIGS. 7 and 8, when a power voltage VCC is provided from an external device, the driving circuit 430 checks whether the third enable signal EN3 is activated to the first level (e.g., a high level) (S510). When the third enable signal EN3 is at the first level, the power converter 420 is controlled to generate the driving voltage VLED.

The driving circuit 430 compares the overvoltage detection voltage OVP with the internal reference voltage REF (S520). When the overvoltage detection voltage OVP is greater than the internal reference voltage REF, the power converter 420 is controlled to stop the generation of the driving voltage VLED (S530). When the overvoltage detection voltage OVP is not greater than the internal reference voltage REF, the power converter 420 is controlled to generate the driving voltage VLED having a predetermined voltage level (S540).

The driving circuit 430 checks whether a voltage level of a first feedback signal FB1 from the first light source module 460 and a voltage level of a second feedback signal FB2 reach a target voltage level (S550). When the voltage level of the first feedback signal FB1 and the voltage level of the second feedback signal FB2 do not reach the target voltage level, the driving circuit 430 controls the power converter 420 to boost up the voltage level of the driving voltage VLED. In a case that the voltage level of the first feedback signal FB1 and the voltage level of the second feedback signal FB2 reach the target voltage level, the driving circuit 430 controls (e.g., regulate) the power converter 420 to generate the driving voltage VLED having the target voltage level (S560).

Figure 9:
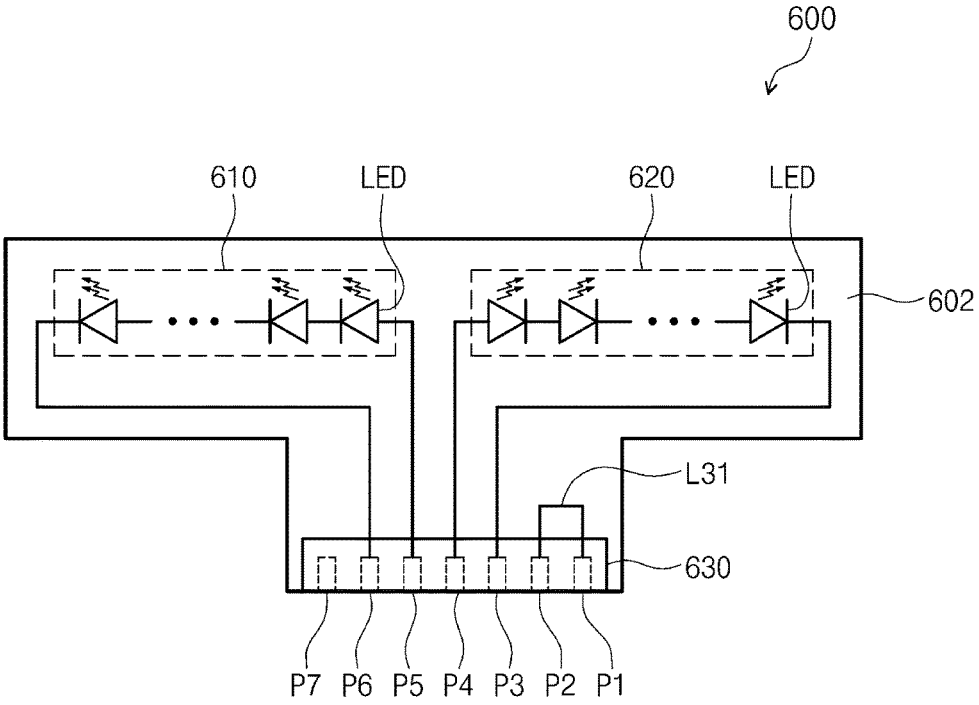
FIG. 9 is a view showing another exemplary embodiment of a light source module according to the invention.

FIG. 9 is a view showing a light source module 600 according to another exemplary embodiment of the invention.

Referring to FIG. 9, the light source module 600 includes a PCB 602 and a first light emitting diode array 610, a second light emitting diode array 620, first, second, third, fourth, fifth, sixth, and seventh connection pins P1, P2, P3, P4, P5, P6, and P7, and a connector 630, which are disposed (e.g., mounted) on the PCB 602. The first to seventh connection pins P1 to P7 are arranged in the connector 630. The connector 630 of the light source module 600 may be inserted into one of the first connector 340 and the second connector 350 shown in FIG. 5.

The first connection pin P1 and the second connection pin P2 are electrically connected to each other via a signal line L31. In an exemplary embodiment, when the light source module 600 is inserted into the first connector 340 shown in FIG. 5, the first connection pin P1 is electrically connected to the first signal line SL11 via the first connector 340, and the second connection pin P2 is electrically connected to the second signal line SL12 via the first connector 340, for example. The first feedback signal FB1 from the third connection pin P3 and the second feedback signal FB2 from the sixth connection pin P6 are applied to the driving circuit 330 through the first connector 340. The fourth connection pin P4 and the fifth connection pin P5 receive the driving voltage VLED from the power converter 320 through the first connector 340. The seventh connection pin P7 is a spare pin.

When the light source module 600 is inserted into the first connector 340, the first enable signal EN1 from the first signal line SL11 may be applied to the first connection pin P1. The first enable signal applied to the first connection pin P1 is transmitted to the second connection pin P2 via the signal line L31. The second enable signal EN2 output from the second connection pin P2 is transmitted to the second connector 350 via the second signal line SL12.

As shown in FIG. 9, the first connection pin P1 and the second connection pin P2 are arranged at one side of the connector 630. In a case that the light source module 600 is inserted into the first connector 340 in a wrong direction, the first enable signal EN1 is not normally applied to the first connection pin P1. In this case, since the driving circuit 330 shown in FIG. 5 does not receive the third enable signal EN3 at the first level, it is determined that the light source module 600 is not connected, and the power converter 320 is controlled not to generate the driving voltage VLED. Therefore, a malfunction caused by the light source module 600 that is wrongly inserted may be prevented from occurring.

Figure 10:
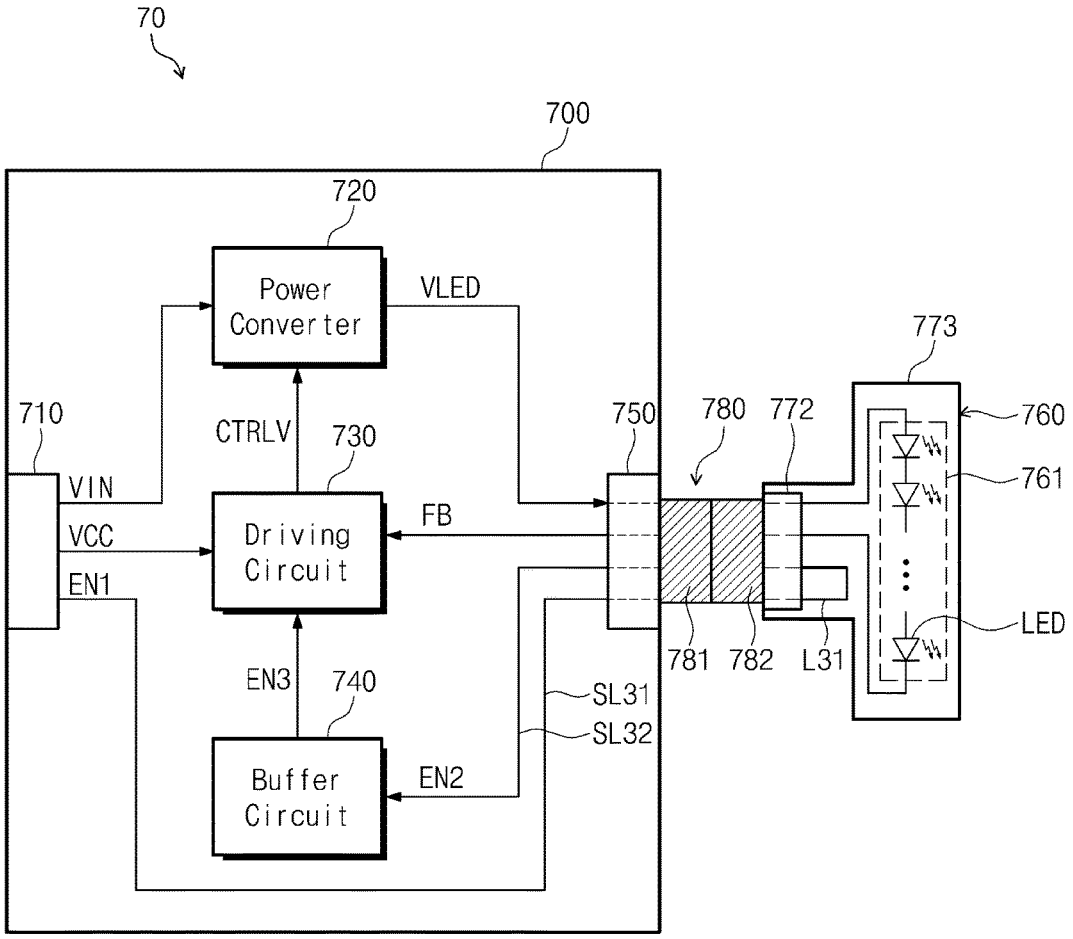
FIG. 10 is a view showing another exemplary embodiment of a backlight unit according to the invention.

FIG. 10 is a view showing a backlight unit 70 according to another exemplary embodiment of the invention.

Referring to FIG. 10, the backlight unit 70 includes a light source driving circuit board 700 and a light source module 760. The light source driving circuit board 700 includes an input connector 710, a power converter 720, a driving circuit 730, a buffer circuit 740, and a connector 750, which are disposed (e.g., mounted) thereon. However, the invention is not limited thereto, and the light source driving circuit board 700 may further include other components desired for an operation of the backlight unit 70 in addition to the above-described components.

Since the input connector 710, the power converter 720, the connector 750, and the light source module 760 have similar structure and function as those of the input connector 110, the power converter 120, the connector 140, and the light source module 150 shown in FIG. 1, detailed descriptions thereof will be omitted.

The buffer circuit 740 outputs a third enable signal EN3 in response to a second enable signal EN2 provided from the connector 750 through a second signal line SL32. The buffer circuit 740 may output the third enable signal EN3 obtained by removing a noise component from the second enable signal EN2.

The driving circuit 730 controls the power converter 720 to generate a driving voltage VLED when the third enable signal EN3 at a first level is applied to the driving circuit 730.

The light source module 760 may include the light emitting diode array 761, the connector 772 and the PCB 773. The backlight unit 70 may further include the connection member 780 including the cable holders 781 and 782.

Figure 11:
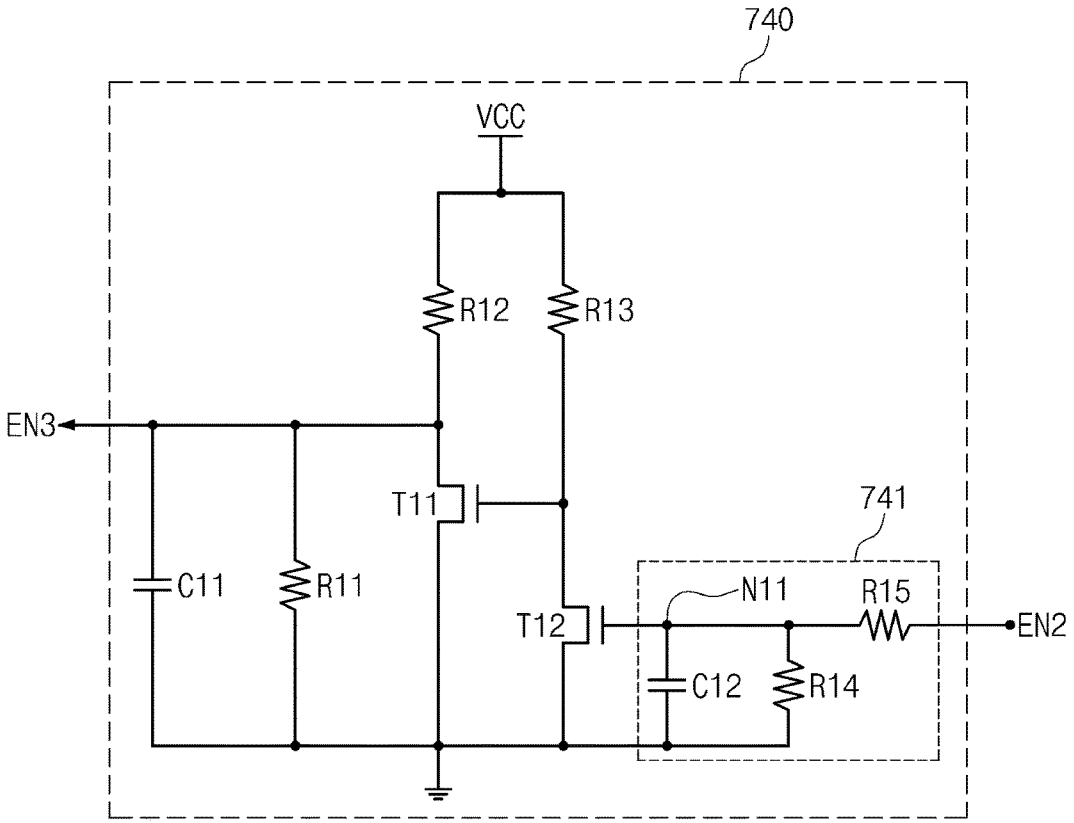
FIG. 11 is a circuit diagram showing a circuit configuration of a buffer circuit shown in FIG. 10.

FIG. 11 is a circuit diagram showing a circuit configuration of the buffer circuit 740 shown in FIG. 10.

Referring to FIG. 11, the buffer circuit 740 includes a filter circuit 741, a first switching transistor T12, a second switching transistor T11, resistors R11 to R13, and a capacitor C11. The filter circuit 741 receives the second enable signal EN2 and outputs a switching signal obtained by removing a high frequency ripple component from the second enable signal EN2. The filter circuit 741 includes resistors R14 and R15 and a capacitor C12 and is operated as a low pass filter. The resistor R15 is connected between a receiving terminal of the second enable signal EN2 and a first node N11. The resistor R14 is connected between the first node N11 and a ground terminal. The capacitor C12 is connected between the first node N11 and the ground terminal.

The resistor R13 includes one end connected to a power voltage VCC and the other end. The first switching transistor T12 includes a first electrode connected to the other end of the resistor R13, a second electrode connected to the ground terminal, and a gate electrode connected to the first node N11. The resistor R12 includes one end connected to the power voltage VCC and the other end. The second switching transistor T11 includes a first electrode connected to the other end of the resistor R12, a second electrode connected to the ground terminal, and a gate electrode connected to the first electrode of the first switching transistor T12. The resistor R11 is connected between the first electrode of the second switching transistor T11 and the ground terminal.

The capacitor C11 is connected between the first electrode of the second switching transistor T11 and the ground terminal.

In a case that the second enable signal EN2 is at a second level, e.g., a low level, the first switching transistor T12 is turned off, and the second switching transistor T11 is turned on. When the second switching transistor T11 is turned on, the third enable signal EN3 is transited to the low level.

In a case that the second enable signal EN2 is at the first level, e.g., a high level, the first switching transistor T12 is turned on, and the second transistor T11 is turned off. When the second switching transistor T11 is turned off, the power voltage VCC is voltage-divided by the resistors R12 and R13, and the divided voltage is output as the third enable signal EN3. In an exemplary embodiment, the power voltage VCC may be about 12 volts, for example. Then, the third enable signal EN3 may be a direct current voltage having a voltage level lower than the power voltage VCC, for example.

Referring back to FIG. 10, the first enable signal EN1 provided from an external device (not shown) is applied to the buffer circuit 740 via a first signal line SL31, the connector 750, a signal line L31 of the light source module 760, and the second signal line SL32. The second enable signal EN2 may have a voltage level lower than that of the first enable signal EN1 in accordance with a length of the first signal line SL31 and the second signal line SL32. In addition, since the signal line L31 of the light source module 760 is disposed adjacent to a signal line transmitting the driving voltage VLED and a feedback signal FB, the second enable signal EN2 may include a noise component.

As shown in FIG. 11, when the second enable signal EN2 is at the high level, a stable direct current voltage having a voltage level lower than that of the power voltage VCC is output as the third enable signal EN3. Therefore, the driving circuit 730 shown in FIG. 10 may be operated in response to the third enable signal EN3 with no signal distortion.

Figure 12:
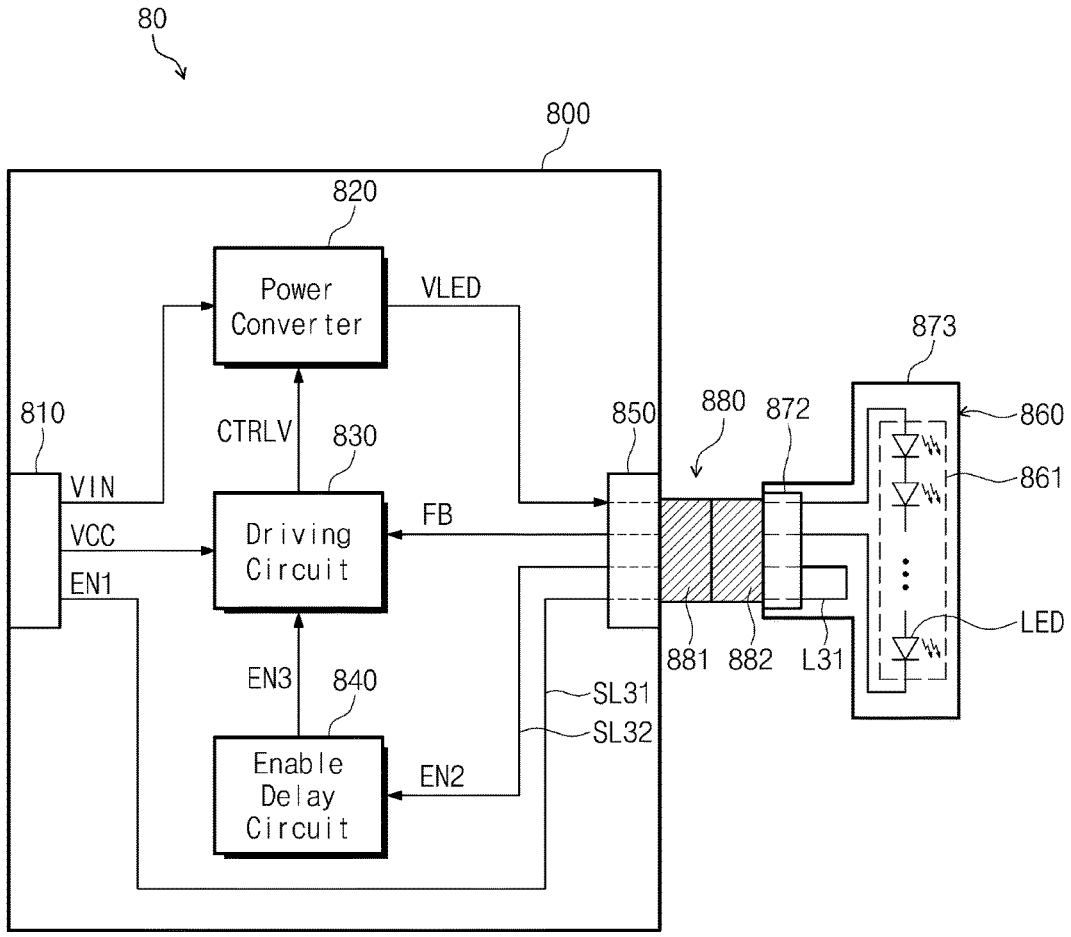
FIG. 12 is a view showing another exemplary embodiment of a backlight unit according to the invention.

FIG. 12 is a view showing a backlight unit 80 according to another exemplary embodiment of the invention.

The backlight unit 80 shown in FIG. 12 includes a light source driving circuit board 800 and a light source module 860. The light source driving circuit board 800 includes an input connector 810, a power converter 820, a driving circuit 830, an enable delay circuit 840, and a connector 850. However, the invention is not limited thereto, and the light source driving circuit board 800 may further include other components desired for an operation of the backlight unit 80 in addition to the above-described components. The light source module 860 may include the light emitting diode array 861, the connector 872 and the PCB 873. The backlight unit 80 may further include the connection member 880 including the cable holders 881 and 882.

Since the backlight unit 80 shown in FIG. 12 has the same structure and function as those of the backlight unit 70 shown in FIG. 10 except for the enable delay circuit 840, detailed descriptions of the same structure will be omitted.

The enable delay circuit 840 applies a third enable signal EN3 obtained by delaying a second enable signal EN2 provided from the light source module 860 to the driving circuit 830.

Figure 13:
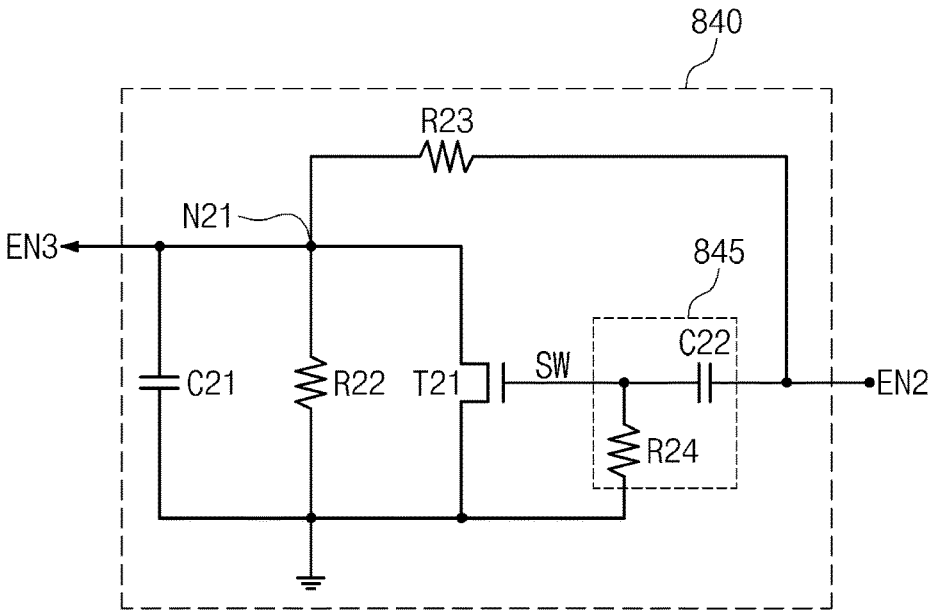
FIG. 13 is a circuit diagram showing an exemplary embodiment of a circuit configuration of an enable delay circuit shown in FIG. 12 according to the invention.
Figure 14:
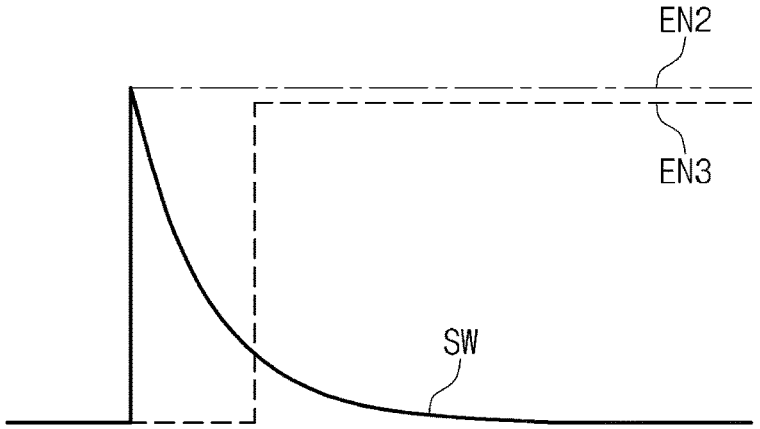
FIG. 14 is a view showing a waveform of a switching signal and a third enable signal of the enable delay circuit shown in FIG. 13.

FIG. 13 is a circuit diagram showing a circuit configuration of the enable delay circuit shown in FIG. 12 according to an exemplary embodiment. FIG. 14 is a view showing a waveform of a switching signal SW and a third enable signal EN3 of the enable delay circuit shown in FIG. 13.

Referring to FIGS. 13 and 14, the enable delay circuit 840 includes a filter circuit 845, a switching transistor T21, resistors R22 and R23, and a capacitor C21. The filter circuit 845 includes a capacitor C22 and a resistor R24 and is operated as a high pass filter.

The switching transistor T21 includes a first electrode connected to an output node N21, a second electrode connected to a ground terminal, and a gate electrode receiving the switching signal SW. The capacitor C21 is connected between the output node N21 and the ground terminal. The resistor R22 is connected between the output node N21 and the ground terminal. The resistor R23 includes one end receiving the second enable signal EN2 and the other end connected to the output node N21.

When the second enable signal EN2 is transited to the high level from the low level, the filter circuit 845 outputs the switching signal SW having a level that temporarily rises to the second enable signal EN2 and gradually falls. When the second enable signal EN2 is transited to the high level from the low level, the level of the switching signal SW rises to the high level, and thus the switching transistor T21 is turned on. Then, the output node N21 is discharged to a ground voltage and maintained in the low level. In a case that a voltage level of the switching signal SW is lowered enough, the switching transistor T21 is turned off. In this case, the second enable signal EN2 is transmitted to the output node N21 via the resistor R23.

As shown in FIG. 14, when a predetermined time passes after the second enable signal EN2 is transited to the high level from the low level, the third enable signal EN3 is transmitted to the high level.

In the backlight unit 80 shown in FIG. 12, when the light source module 860 is not connected to the connector 850, the third enable signal EN3 is maintained in the low level. When the light source module 860 contacts the connector 850 while a user does not block the input voltage VIN and the power voltage VCC applied to the backlight unit 80, an instantaneous high voltage may be applied to the light source module 860.

According to the enable delay circuit 840 shown in FIG. 13, when a predetermined time passes after the second enable signal EN2 is transited to the high level from the low level, the third enable signal EN3 is transited to the high level, and thus the generation of the driving voltage VLED from the power converter 820 may be delayed for a predetermined time. Thus, the light source module 860 may be prevented from being damaged due to the instantaneous high voltage applied thereto.

Figure 15:
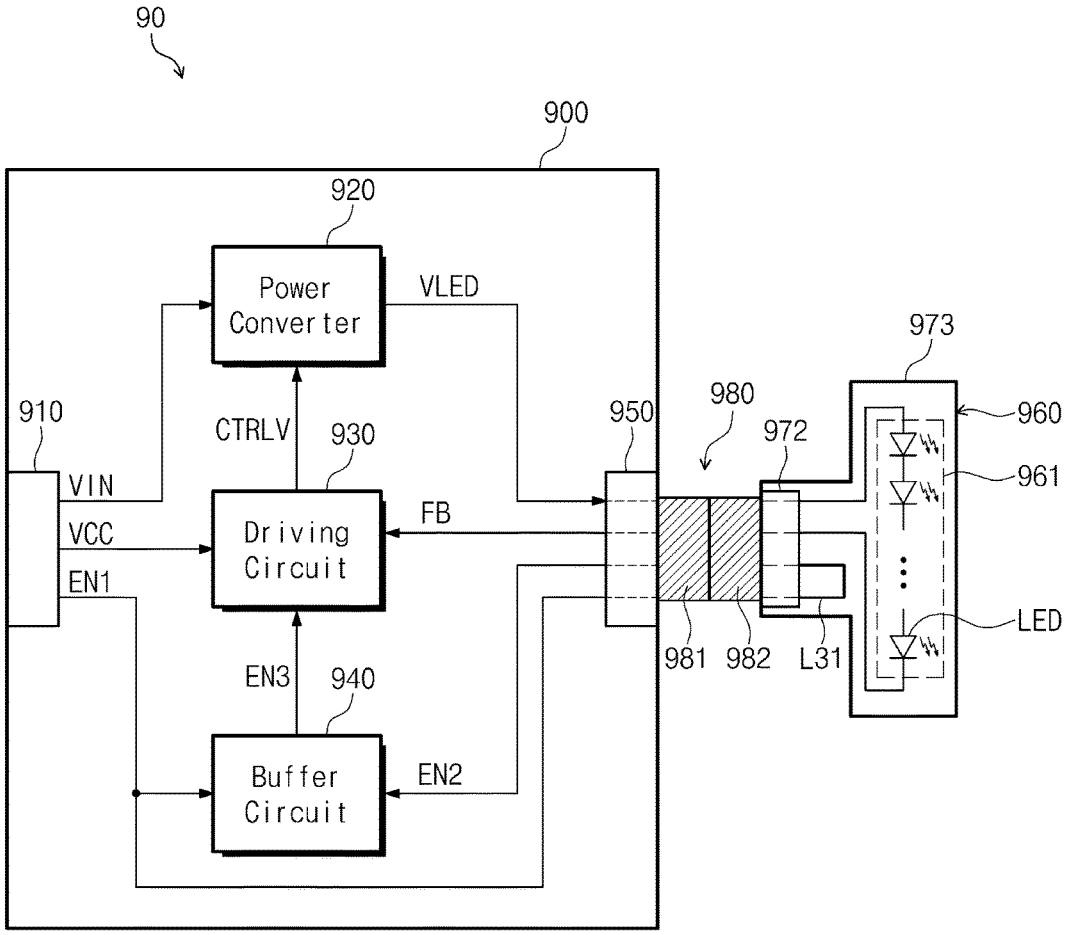
FIG. 15 is a view showing another exemplary embodiment of a backlight unit according to the invention.

FIG. 15 is a view showing a backlight unit 90 according to another exemplary embodiment of the invention.

Referring to FIG. 15, the backlight unit 90 includes a light source driving circuit board 900 and a light source module 960. The light source driving circuit board 900 includes an input connector 910, a power converter 920, a driving circuit 930, a buffer circuit 940, and a connector 950, which are disposed (e.g., mounted) thereon. The light source driving circuit board 900 may further include other components desired for an operation of the backlight unit 90 in addition to the above-described components.

Since the input connector 910, the power converter 920, the connector 950, and the light source module 960 have the similar structure and function as those of the input connector 110, the power converter 120, the connector 140, and the light source module 150 shown in FIG. 1, detailed descriptions thereof will be omitted.

The buffer circuit 940 outputs a third enable signal EN3 in response to a first enable signal EN1 from the input connector 910 and a second enable signal EN2 from the connector 950. The buffer circuit 940 outputs the third enable signal EN3 obtained by removing a noise component from the second enable signal EN2. The driving circuit 930 controls the power converter 920 in response to the third enable signal EN3 at a first level to generate a driving voltage VLED.

The light source module 960 may include the light emitting diode array 961, the connector 972 and the PCB 973. The backlight unit 90 may further include the connection member 980 including the cable holders 981 and 982.

Figure 16:
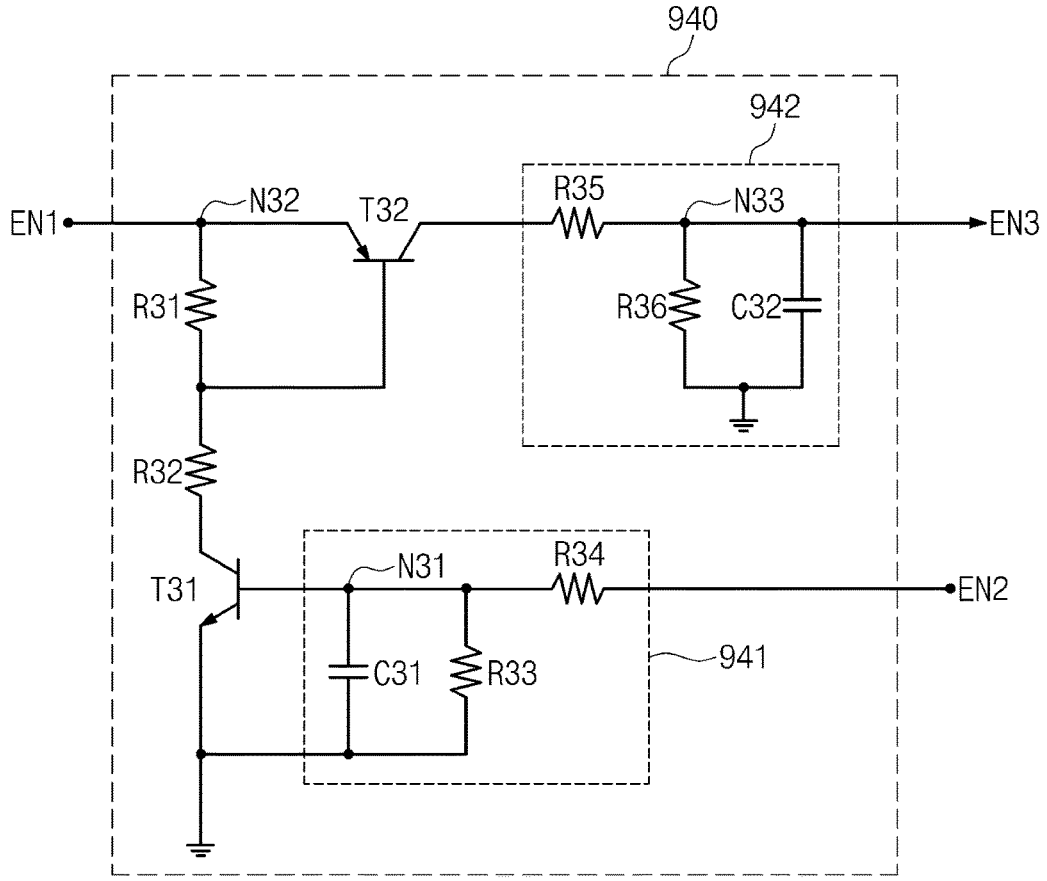
FIG. 16 is a circuit diagram showing a circuit configuration of a buffer circuit shown in FIG. 15.

FIG. 16 is a circuit diagram showing a circuit configuration of the buffer circuit 940 shown in FIG. 15.

Referring to FIG. 16, the buffer circuit 940 includes a first filter circuit 941, a second filter circuit 942, a first switching transistor T31, a second switching transistor T32, and resistors R31 and R32. The first filter circuit 941 receives the second enable signal EN2 and outputs a switching signal obtained by removing a high frequency ripple component from the second enable signal EN2. The first filter circuit 941 includes resistors R33 and R34 and a capacitor C31 and is operated as a low pass filter. The resistor R34 is connected between a receiving terminal of the second enable signal EN2 and a first node N31. The resistor R33 is connected between the first node N31 and a ground terminal. The capacitor C31 is connected between the first node N31 and the ground terminal.

The first switching transistor T31 includes a first electrode, a second electrode connected to the ground terminal, and a gate electrode connected to the first node N31. The resistors R31 and R32 are sequentially connected between a second node N32 receiving the first enable signal EN1 and one end of the first switching transistor T31 in series. The second switching transistor T32 includes a first electrode connected to the second node N32, a second electrode, and a gate electrode connected to a connection node between the resistors R31 and R32.

The second filter circuit 942 receives a signal output from the second electrode of the second switching transistor T32 and outputs the third enable signal EN3. The second filter circuit 942 includes resistors R35 and R36 and a capacitor C32 and is operated as a low pass filter. The resistor R35 is connected between the second electrode of the second switching transistor T32 and a third node N33. The resistor R36 is connected between the third node N33 and the ground terminal. The capacitor C32 is connected between the third node N33 and the ground terminal.

When the second enable signal EN2 is at a low level, the first switching transistor T31 is turned off, and in this case, since the first enable signal EN1 is at the low level, the second switching transistor T32 is turned off. Accordingly, the third enable signal EN3 is maintained in the low level.

When the second enable signal EN2 is at a high level, the first switching transistor T31 is turned on. In this case, the first enable signal EN1 is at the high level, and thus the second switching transistor T32 is turned on. Therefore, the first enable signal EN1 received through the second switching transistor T32 may be output as the third enable signal EN3 after a ripple component from the first enable signal EN1 is removed by the second filter circuit 942. The second enable signal EN2 controls a turning on/off of the first switching transistor T31 after the noise component from the second enable signal EN2 is removed by the first filter circuit 941, and a noise component from the first enable signal EN1 is removed by the second filter circuit 942. Thus, the third enable signal EN3 may be output at a stable level.

Figure 17:
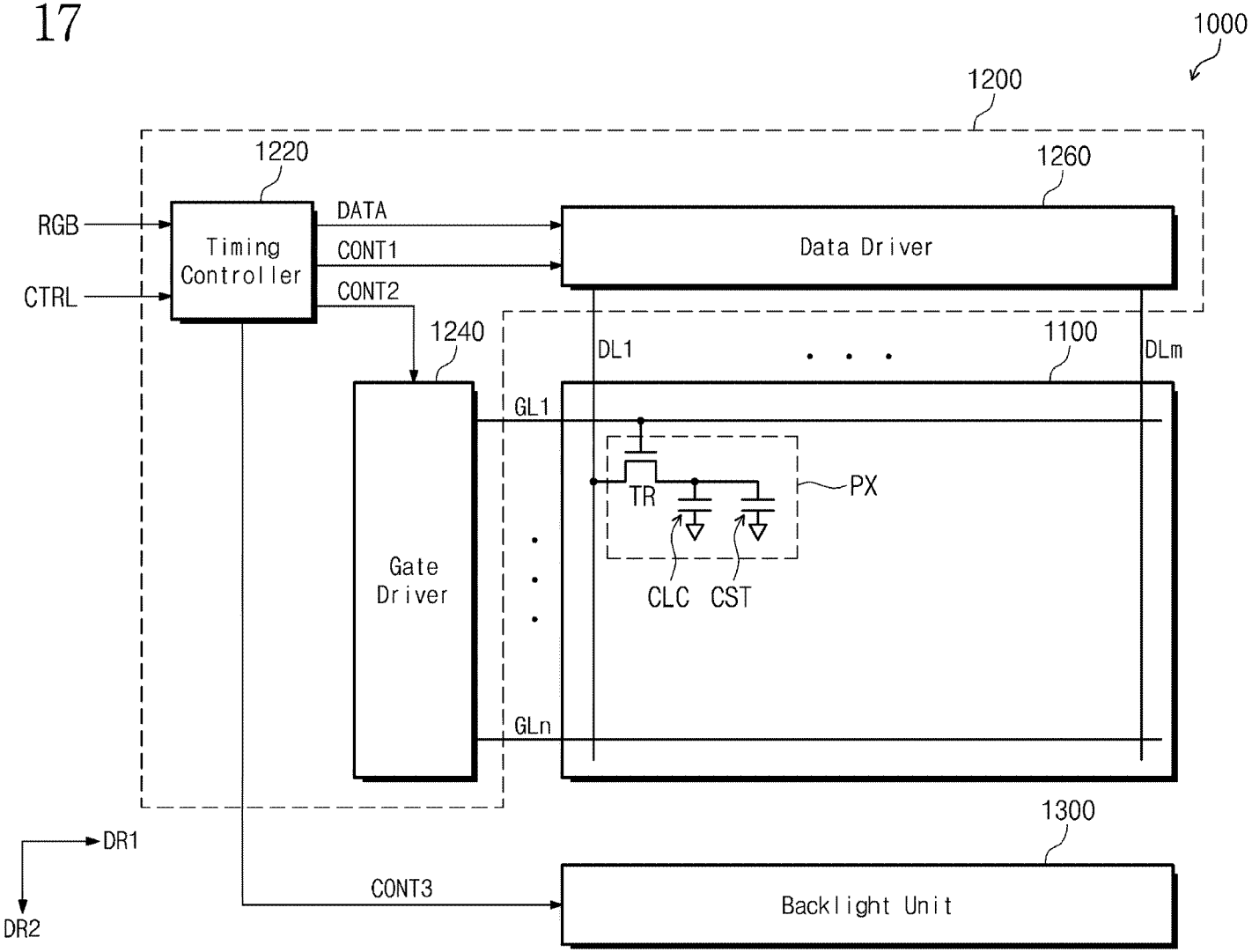
FIG. 17 is a block diagram showing an exemplary embodiment of a display device according to the invention.

FIG. 17 is a block diagram showing a display device 1000 according to an exemplary embodiment of the invention.

Referring to FIG. 17, the display device 1000 includes a display panel 1100, a driving circuit 1200, and a backlight unit 1300.

The display panel 1100 displays an image. In the exemplary embodiment, a liquid crystal display panel will be described as the display panel 1100, but the display panel 1100 should not be limited to the liquid crystal display panel. That is, other types of display panels may be used as the display panel 1100 as long as the display panel uses the backlight unit 1300.

The display panel 1100 includes a plurality of gate lines GL1 to GLn (n is a natural number greater than 1) extending in a first direction DR1, a plurality of data lines DL1 to DLm (m is a natural number greater than 1) extending in a second direction DR2, and a plurality of pixels PX arranged in areas defined by the gate lines GL1 to GLn crossing the data lines DL1 to DLm. The data lines DL1 to DLm are insulated from the gate lines GL1 to GLn. Each of the pixels PX includes a thin film transistor ("TFT") TR, a liquid crystal capacitor CLC, and a storage capacitor CST.

The pixels PX have the same pixel configuration. Thus, only one pixel will be described in detail, and details of the other pixels PX will be omitted. The TFT TR of the pixel PX includes a gate electrode connected to a first gate line GL1 of the gate lines GL1 to GLn, a source electrode connected to a first data line DL1 of the data lines DL1 to DLm, and a drain electrode commonly connected to the liquid crystal capacitor CLC and the storage capacitor CST. One end of the liquid crystal capacitor CLC and one end of the storage capacitor CST are connected in parallel to the drain electrode of the TFT TR. The other end of the liquid crystal capacitor CLC and the other end of the storage capacitor CST receive a common voltage.

The driving circuit 1200 includes a timing controller 1220, a gate driver 1240, and a data driver 1260. The timing controller 1220 receives an image signal RGB and control signals CTRL from an external device. In an exemplary embodiment, the control signals CTRL may include a vertical synchronization signal, a horizontal synchronization signal, a main clock signal, and a data enable signal, etc., for example. The timing controller 1220 provides an image data signal DATA, which is obtained by processing the image signal RGB in accordance with an operational environment of the display panel 1100 based on the control signals CTRL, and a first control signal CONT1 to the data driver 1260, and the timing controller 1220 provides a second control signal CONT2 to the gate driver 1240. In an exemplary embodiment, the first control signal CONT1 may include a horizontal synchronization start signal, a clock signal, and a line latch signal, and the second control signal CONT2 may include a vertical synchronization start signal, an output enable signal, and a gate pulse signal, for example. The timing controller 1220 may output the image data signal DATA after changing the image data signal DATA in various ways in accordance with an arrangement of the pixels PX and a display frequency of the display panel 1100. The timing controller 1220 provides a third control signal CONT3 to the backlight unit 1300 to control the backlight unit 1300.

The gate driver 1240 drives the gate lines GL1 to GLn in response to the second control signal CONT2 from the timing controller 1220. In exemplary embodiments, the gate driver 1240 may include a gate driving integrated circuit, for example. In exemplary embodiments, the gate driver 1240 may be implemented by a circuit with an oxide semiconductor, an amorphous semiconductor, a crystalline semiconductor, or a polycrystalline semiconductor, for example.

The data driver 1260 drives the data lines DL1 to DLm in response to the image data signal DATA and the first control signal CONT1 from the timing controller 1220.

The backlight unit 1300 is disposed under the display panel 1100 to face the pixels PX. The backlight unit 1300 is operated in response to the third control signal CONT3 from the timing controller 1220. The backlight unit 1300 may include at least one of the configurations shown in FIGS. 1 to 16.

Figure 18:
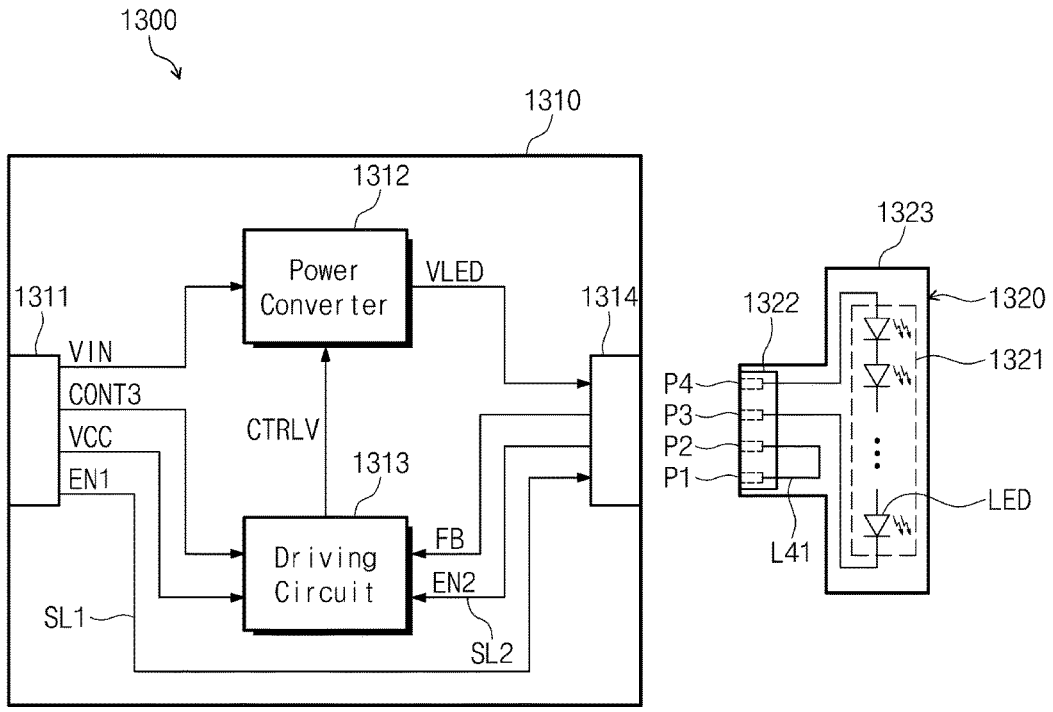
FIG. 18 is a view showing a backlight unit shown in FIG. 17.

FIG. 18 is a view showing the backlight unit 1300 shown in FIG. 17.

Referring to FIG. 18, the backlight unit 1300 includes a light source driving circuit board 1310 and a light source module 1320. The light source driving circuit board 1310 includes an input connector 1311, a power converter 1312, a driving circuit 1313, and a connector 1314, which are disposed (e.g., mounted) thereon. However, the invention is not limited thereto, and the light source driving circuit board 1310 may further include other components desired for an operation of the backlight unit 1300 in addition to the above-described components.

The input connector 1311 receives an input voltage VIN, a power voltage VCC, a third control signal CONT3, and a first enable signal EN1 from an external device (not shown). The power converter 1312 receives the input voltage VIN from the input connector 1311 and a power control signal CTRLV from the driving circuit 1313 to generate a driving voltage VLED. The driving circuit 1313 receives the power voltage VCC and the third control signal CONT3 from the input connector 1311 and a feedback signal FB and a second enable signal EN2 from the connector 1314 to output the power control signal CTRLV. The driving circuit 1313 may uniformly control an amount of electric current flowing through a light emitting diode array 1321 in response to the feedback signal FB.

The first enable signal EN1 provided from the input connector 1311 is applied to the connector 1314 via a first signal line SL1. The second enable signal EN2 provided from the connector 1314 is applied to the driving circuit 1313 via a second signal line SL2. The connector 1314 accommodates a portion of the light source module 1320 and electrically connects the light source module 1320 to the power converter 1312 and the driving circuit 1313.

The light source module 1320 includes a PCB 1323, the light emitting diode array 1321, and a connector 1322. The light emitting diode array 1321 and the connector 1322 are disposed (e.g., mounted) on the PCB 1323. First, second, third, and fourth connection pins P1, P2, P3, and P4 are arranged in the connector 1322. The connector 1322 and a body part 1323 may be integrally provided as a single unitary and individual unit. The connector 1322 of the light source module 1320 may be connected to the connector 1314 of the light source driving circuit board 1310. The first and second connection pins P1 and P2 may be connected to each other via a signal line L41.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A backlight unit comprising:

a light source module;

a power converter which applies a driving voltage to the light source module;

a first connector which receives a first enable signal via a first signal line and applies a second enable signal via a second signal line;

a driving circuit which controls a generation of the driving voltage from the power converter in response to the second enable signal; and an input connector which applies a power voltage to a first input terminal of the driving circuit, wherein the light source module comprises a second connector which applies the second enable signal to the driving circuit, a first connection pin and a second connection pin electrically connected to the first connection pin, wherein, when the first connector is electrically connected to the first connection pin and the second connection pin of the light source module, the first enable signal is transmitted to the first connection pin of the light source module via the first signal line and the first connector, and the second enable signal from the second connection pin of the light source module is transmitted to a second input terminal of the driving circuit different from the first input terminal via the first connector and the second signal line, and the first connector and the second connector are detachable from each other such that the second connector does not apply the second enable signal with a first level to the driving circuit when the first connector and the second connector are detached from each other.

2. The backlight unit of claim 1, wherein the driving circuit controls the power converter to generate the driving voltage when the second enable signal is received at the first level.

3. The backlight unit of claim 1, wherein the first enable signal and the second enable signal are substantially the same as each other.

4. The backlight unit of claim 1, wherein the driving circuit is implemented by an integrated circuit, and the light source module, the power converter, the driving circuit, and the first connector are disposed on a light source driving circuit board.

5. The backlight unit of claim 1, wherein the input connector receives the first enable signal from an external device.

6. The backlight unit of claim 1, further comprising an overvoltage detector comprising at least two resistors sequentially connected between a voltage output terminal of the power converter outputting the driving voltage and a ground voltage in series, wherein the driving circuit controls the power converter to stop the generation of the driving voltage when a voltage of a node between the at least two resistors is greater than a reference voltage.

7. The backlight unit of claim 1, further comprising a buffer circuit which receives the second enable signal from the first connector via the second signal line and outputs a third enable signal obtained by removing a noise from the second enable signal, wherein the driving circuit controls the generation of the driving voltage from the power converter in response to the third enable signal.

8. The backlight unit of claim 7, wherein the buffer circuit comprises:

a filter circuit which receives the second enable signal and outputs a switching signal to a first node;

a first switching transistor comprising a first electrode connected to the power voltage, a gate electrode connected to the first node, and a second electrode connected to a ground voltage; and a second switching transistor comprising a first electrode connected to the power voltage, a gate electrode connected to the first electrode of the first switching transistor, and a second electrode connected to the ground voltage, and a signal from the first electrode of the second switching transistor is the third enable signal.

9. The backlight unit of claim 1, further comprising an enable delay circuit which receives the second enable signal from the first connector via the second signal line and outputs a third enable signal obtained by delaying the second enable signal, wherein the driving circuit controls the generation of the driving voltage from the power converter in response to the third enable signal.

10. The backlight unit of claim 9, wherein the enable delay circuit comprises:

a filter circuit which receives the second enable signal and outputs a switching signal;

a resistor connected between the second enable signal and an output node; and a switching transistor comprising a first electrode connected to the output node, a gate electrode receiving the switching signal, and a second electrode connected to a ground voltage.

11. The backlight unit of claim 1, further comprising a buffer circuit which receives the first enable signal and outputs a third enable signal in response to the second enable signal, wherein the driving circuit controls the generation of the driving voltage from the power converter in response to the third enable signal.

12. The backlight unit of claim 11, wherein the buffer circuit comprises:

a first filter circuit which receives the second enable signal and outputting a first switching signal;

a first switching transistor comprising a first electrode connected to a switching node, a gate electrode connected to the first switching signal, and a second electrode connected to a ground voltage;

a second switching transistor comprising a first electrode connected to the first enable signal, a gate electrode connected to the switching node, and a third electrode; and a second filter circuit which receives a signal of the third electrode of the second switching transistor and outputs the third enable signal.

13. A backlight unit comprising:

a first light source module comprising a first connection pin and a second connection pin electrically connected to the first connection pin;

a second light source module comprising a third connection pin and a fourth connection pin electrically connected to the third connection pin;

a power converter which provides a driving voltage to the first light source module and the second light source module;

a first connector electrically connected to the first and second connection pins;

a second connector electrically connected to the third and fourth connection pins;

a first signal line which transmits a first enable signal to the first connector;

a second signal line which transmits a second enable signal from the first connector to the second connector;

a third signal line which transmits a third enable signal from the second connector;

a driving circuit which controls a generation of the driving voltage from the power converter in response to the third enable signal;

an input connector which applies a power voltage to a first input terminal of the driving circuit; and a third connector which applies the third enable signal to the driving circuit, and wherein, when the first connector is electrically connected to the first and second connection pins and the second connector is electrically connected to the third and fourth connection pins, the first enable signal is transmitted to the first connection pin of the first light source module via the first signal line and the first connector, the second enable signal from the second connection pin of the first light source module is transmitted to the third connection pin of the second light source module via the second signal line and the second connector, and the third enable signal from the fourth connection pin of the second light source module is transmitted to a second input terminal of the driving circuit different from the first input terminal via the second connector and the third signal line, and the first connector and the second connector are detachable from the third connector such that the third connector does not apply the third enable signal with a first level to the driving circuit when at least one of the first connector and the second connector are detached from the third connector.

14. The backlight unit of claim 13, wherein, when the third enable signal is received at the first level, the driving circuit controls the power converter to generate the driving voltage.

15. The backlight unit of claim 13, wherein the first enable signal, the second enable signal, and the third enable signal are substantially the same as each other.

16. A display device comprising:

a display panel comprising a plurality of pixels;

a panel driving circuit which controls the display panel to display an image; and a backlight unit which provides a light to the display panel, the backlight unit comprising:

a light source module;

a power converter which provides a driving voltage to the light source module;

a first connector which receives a first enable signal via a first signal line and provides a second enable signal via a second signal line;

a driving circuit which controls a generation of the driving voltage from the power converter in response to the second enable signal; and an input connector which applies a power voltage to a first input terminal of the driving circuit, wherein the light source module comprises a second connector which applies the second enable signal to the driving circuit, a first connection pin and a second connection pin electrically connected to the first connection pin, wherein, when the first connector is electrically connected to the first connection pin and the second connection pin of the light source module, the first enable signal is transmitted to the first connection pin of the light source module via the first signal line and the first connector, and the second enable signal from the second connection pin of the light source module is transmitted to a second input terminal of the driving circuit different from the first input terminal via the first connector and the second signal line, and the first connector and the second connector are detachable from each other such that the second connector does not apply the second enable signal with a first level to the driving circuit when the first connector and the second connector are detached from each other.

17. The display device of claim 16, wherein the driving circuit controls the power converter to generate the driving voltage when the second enable signal is received at the first level.

18. The display device of claim 16, wherein the panel driving circuit comprises:

a gate driver which drives a plurality of gate lines connected to the plurality of pixels in a first direction;

a data driver which drives a plurality of data lines connected to the plurality of pixels in a second direction different from the first direction; and a timing controller which controls the gate driver and the data driver and outputting a backlight control signal, and the driving circuit controls the generation of the driving voltage from the power converter in response to the backlight control signal.

19. A method of operating a backlight unit, the method comprising:

receiving a first enable signal via a first signal line;

transmitting the first enable signal to a first connection pin of a first connector of a light source module;

receiving, by a driving circuit, a second enable signal from a second connection pin of the light source module via a second signal line connected to a second connector;

generating a driving voltage only when the second enable signal is at a first level; and providing the driving voltage to the light source module, wherein the first connector and the second connector are detachable from each other such that the second connector does not apply the second enable signal with the first level to the driving circuit when the first connector and the second connector are detached from each other.

20. The method of claim 19, further comprising:

comparing the driving voltage with a reference voltage;

stopping the generation of the driving voltage when the driving voltage is greater than the reference voltage.

* * * * *